US009320360B2

(12) United States Patent
Bauer

(10) Patent No.: US 9,320,360 B2
(45) Date of Patent: Apr. 26, 2016

(54) ARMREST ASSEMBLY

(71) Applicant: Holland Plastics Corporation, Grand Haven, MI (US)

(72) Inventor: Nathaniel David Bauer, Grand Haven, MI (US)

( * ) Notice: Subject to any disclaimer, the term of this patent is extended or adjusted under 35 U.S.C. 154(b) by 202 days.

(21) Appl. No.: 14/101,421

(22) Filed: Dec. 10, 2013

(65) Prior Publication Data

US 2014/0167478 A1 Jun. 19, 2014

Related U.S. Application Data

(60) Provisional application No. 61/737,733, filed on Dec. 14, 2012.

(51) Int. Cl.
*A47C 7/54* (2006.01)
*A47C 1/03* (2006.01)

(52) U.S. Cl.
CPC .... *A47C 7/54* (2013.01); *A47C 1/03* (2013.01)

(58) Field of Classification Search
CPC ..... A47C 1/03; A47C 7/54
USPC ..... 297/411.38
See application file for complete search history.

(56) References Cited

U.S. PATENT DOCUMENTS

| | | | | |
|---|---|---|---|---|
| 3,934,927 | A | 1/1976 | Zur | |
| 4,085,967 | A | 4/1978 | Spencer | |
| 4,097,088 | A | 6/1978 | Meiller | |
| 4,176,878 | A | 12/1979 | Koutsky | |
| 4,674,798 | A | 6/1987 | Oeth et al. | |
| 5,188,423 | A * | 2/1993 | Meiller | B60N 2/46 297/411.38 |
| 5,383,704 | A | 1/1995 | Granados et al. | |
| 5,415,459 | A | 5/1995 | Schultz | |
| 5,439,267 | A | 8/1995 | Peterson et al. | |
| 5,439,268 | A | 8/1995 | Dozsa-Farkas | |
| 5,558,404 | A * | 9/1996 | Muzzy | B60N 2/4626 297/411.38 |
| 5,599,067 | A | 2/1997 | Schuelke et al. | |
| 5,612,718 | A | 3/1997 | Bryan | |
| 5,667,277 | A | 9/1997 | Van De Riet | |
| 5,676,483 | A | 10/1997 | Koubek | |
| 5,733,010 | A | 3/1998 | Lewis et al. | |
| 5,749,628 | A | 5/1998 | Synder et al. | |
| 5,848,823 | A | 12/1998 | Su | |
| 5,884,975 | A | 3/1999 | Su | |
| 5,924,769 | A | 7/1999 | Kao | |
| 5,931,537 | A | 8/1999 | Gollin et al. | |
| 5,971,484 | A | 10/1999 | Lamart et al. | |
| 5,984,416 | A | 11/1999 | Waldo et al. | |
| 6,017,091 | A | 1/2000 | Cao | |
| 6,053,578 | A | 4/2000 | van Hekken et al. | |
| 6,076,892 | A | 6/2000 | van Hekken et al. | |
| 6,132,001 | A | 10/2000 | Su | |
| 6,139,107 | A | 10/2000 | Lee | |

(Continued)

*Primary Examiner* — David R Dunn
*Assistant Examiner* — Tania Abraham
(74) *Attorney, Agent, or Firm* — Hultman Law, PLC; Eric Andrew Hultman, Esq.

(57) ABSTRACT

An adjustable armrest for a chair is disclosed herein and comprises an assembly of a mounting plate, a support column, an anti-rotation feature, and two arms. The adjustable armrest's mounting plate is positionable laterally and rotationally about the support column when the anti-rotation feature is disengaged, and is restrained when the anti-rotation feature is engaged. The anti-rotation feature restrains the position of the mounting plate by restraining the rotation of the two arms and is preferably controlled via an actuator button.

21 Claims, 24 Drawing Sheets

(56) References Cited

U.S. PATENT DOCUMENTS

| | | | | |
|---|---|---|---|---|
| 6,168,237 | B1 | 1/2001 | Lamart et al. | |
| 6,176,550 | B1 | 1/2001 | Lamart et al. | |
| 6,209,960 | B1 | 4/2001 | Bradbury | |
| 6,213,556 | B1 | 4/2001 | Chen | |
| 6,290,300 | B1 | 9/2001 | Sutton et al. | |
| 6,296,312 | B1 | 10/2001 | Congleton et al. | |
| 6,302,486 | B1 | 10/2001 | Lamart et al. | |
| 6,343,839 | B1 | 2/2002 | Simons, Jr. et al. | |
| 6,394,553 | B1 | 5/2002 | McAllister et al. | |
| 6,398,309 | B1 | 6/2002 | Chen | |
| 6,425,636 | B2 | 7/2002 | Chen | |
| 6,460,932 | B1 | 10/2002 | Kopish et al. | |
| 6,467,847 | B2 | 10/2002 | Bidare | |
| 6,502,904 | B1 | 1/2003 | Hansen | |
| 6,540,300 | B2 | 4/2003 | Piretti | |
| 6,578,922 | B2 | 6/2003 | Khedira et al. | |
| 6,588,847 | B2 | 7/2003 | Murakami | |
| 6,619,746 | B2 | 9/2003 | Roslund, Jr. et al. | |
| 6,663,182 | B1 | 12/2003 | Dolci et al. | |
| 6,663,183 | B1 | 12/2003 | Liao | |
| 6,719,367 | B2 | 4/2004 | Mic et al. | |
| 6,799,803 | B1 | 10/2004 | Lee et al. | |
| 6,802,566 | B2 | 10/2004 | Prince et al. | |
| 6,893,386 | B2 | 5/2005 | Charoenchit | |
| 6,908,158 | B2 | 6/2005 | Willette et al. | |
| 6,948,774 | B2 | 9/2005 | Maier et al. | |
| 6,948,775 | B2 | 9/2005 | Tsai | |
| 6,974,189 | B2 | 12/2005 | Machael et al. | |
| 6,974,190 | B1 | 12/2005 | Hung | |
| 7,066,546 | B2 | 6/2006 | Trego et al. | |
| 7,114,781 | B2 | 10/2006 | Costaglia | |
| 7,150,504 | B1 | 12/2006 | Lee | |
| 7,156,466 | B1 | 1/2007 | Chang | |
| 7,159,947 | B1 | 1/2007 | Lee | |
| 7,188,907 | B1 | 3/2007 | Lai | |
| 7,201,449 | B2 | 4/2007 | Tsai | |
| 7,201,450 | B1 | 4/2007 | Chen | |
| 7,234,779 | B2 * | 6/2007 | Bedford | A47C 1/03 297/344.16 |
| 7,341,313 | B2 | 3/2008 | Bedford et al. | |
| 7,360,839 | B1 | 4/2008 | Chen | |
| 7,387,341 | B1 | 6/2008 | Tsai | |
| 7,434,887 | B1 | 10/2008 | Hsien | |
| 7,559,609 | B2 | 7/2009 | Tsai | |
| 7,581,791 | B2 | 9/2009 | Diffrient | |
| 7,641,284 | B2 | 1/2010 | Jones et al. | |
| 7,648,207 | B2 * | 1/2010 | Lai | A47C 1/03 297/411.31 |
| 7,815,259 | B2 | 10/2010 | Fookes et al. | |
| 7,837,269 | B2 | 11/2010 | Bock | |
| 7,857,393 | B2 | 12/2010 | Cebula et al. | |
| 7,862,123 | B2 | 1/2011 | Baker et al. | |
| 7,980,631 | B2 | 7/2011 | Diffrient | |
| 8,002,357 | B2 | 8/2011 | Cebula et al. | |
| 8,016,360 | B2 | 9/2011 | Machael et al. | |
| 8,061,778 | B2 | 11/2011 | Machael et al. | |
| 8,104,837 | B2 | 1/2012 | Diffrient | |
| 8,226,171 | B2 | 7/2012 | Fang | |
| 8,235,468 | B2 | 8/2012 | Fookes et al. | |
| 8,246,117 | B2 | 8/2012 | Melhuish et al. | |
| 8,622,477 | B2 | 1/2014 | Colasanti et al. | |
| 2003/0030317 | A1 * | 2/2003 | Chen | A47C 1/03 297/411.35 |
| 2008/0150341 | A1 * | 6/2008 | Salewski | B60N 2/4613 297/411.38 |
| 2009/0140566 | A1 * | 6/2009 | Canedo Pardo | B60N 2/444 297/411.38 |
| 2009/0195045 | A1 * | 8/2009 | Lai | A47C 1/03 297/411.35 |
| 2009/0302661 | A1 | 12/2009 | Melhuish et al. | |
| 2011/0248543 | A1 * | 10/2011 | Hitchcock | A47C 1/03 297/411.36 |
| 2012/0025584 | A1 * | 2/2012 | Chen | A47C 7/68 297/411.37 |
| 2012/0175934 | A1 * | 7/2012 | Bock | A47C 1/03 297/411.37 |

* cited by examiner

ARMREST ASSEMBLY

CROSS REFERENCE TO RELATED APPLICATION

This application is a non-provisional application claiming priority to an earlier filed U.S. provisional patent application entitled, "ARM REST ASSEMBLY," filed Dec. 14, 2012, and assigned Ser. No. 61/737,733, the contents of which are incorporated herein by reference.

BACKGROUND OF THE INVENTION

1. Field of the Invention

The present invention generally relates to armrests for chairs, and more specifically to adjustable armrests for chairs.

2. Description of the Related Art

Office chairs are a common fixture in today's office environment, providing ergonomically positioned support surfaces which allow their users to remain seated for extended periods of time. It is desirable that office chairs include adjustable features, such as adjustable seating height and adjustable lumbar support, which may be positioned to suit an individual user. However, today's office chairs have armrests which lack the desired level of adjustability. Armrests found in the prior art offer limited forms of adjustment, often through complex mechanisms requiring separate releases for each individual motion.

The invention described herein solves these disadvantages, providing an adjustable armrest assembly which is positionable in three or more degrees of freedom, yet also features a retention mechanism for stability. The invention comprises a fore-aft restraint system and an anti-rotation feature, preferably controlled by a single actuator button. The armrest may be freely repositioned when the actuator button is depressed, yet locks into position when the button is released. The inventive design also reduces the number of assembly components to a minimum, thus reducing the manufacturing costs, the assembly complexity, and the number of potential component failure modes.

SUMMARY OF THE INVENTION

In one embodiment of the invention, the adjustable arm rest for a chair comprises: a support column, a first arm, and a second arm, wherein both arms are pivotally attached to said support column. The first arm and second arms are also pivotally attached to a mounting plate. A positionable anti-rotation feature is also fitted to the support column and is positionable between an engaged configuration and a non-engaged configuration. When the anti-rotation feature is placed into the engaged configuration, rotation of the first and second arms is restrained. When the anti-rotation feature is placed into the non-engaged configuration, the first and second arms are allowed to rotate.

In a second embodiment of the invention, the adjustable arm rest for a chair comprises a socket arm having a base, an arm member attached to the base, and a pivot attachment pivotally connected to the arm member. The assembly also includes a pin arm having a base, an arm member attached to the base, a main shaft extending away from the pin arm's base and a pivot attachment pivotally attached to the arm member. Both arms are pivotally attached to a support column using their respective bases, and are pivotally attached to a slot in a mounting plate using the aforementioned pivot attachments, wherein the pivot attachments may pivot and slide along the slot in the mounting plate.

Included in the support column is a first epicyclic gearset comprising a first planetary gear, a first sun gear located on a portion of the socket arm's base, and a first annulus gear. A second epicyclic gearset is also included in the support column, comprising a second planetary gear, a second sun gear located on a portion of said pin arm's main shaft, and a second annulus gear. An anti-rotation feature is also included, and is positionable between an engaged configuration and a non-engaged configuration using an actuator button. When the anti-rotation feature is placed into the engaged configuration, the rotation of said pin arm and said socket arm is restrained. When said anti-rotation feature is placed into the non-engaged configuration, said pin arm and said socket arm are allowed to rotate.

In still another embodiment of the invention, the adjustable arm rest for a chair comprises the components from the second embodiment of the invention, but also includes an aperture placed through at least one of the pivot attachments, a torque bar comprising at least one frictional face, and an arm gear which is pivotally mounted to the base portion of the mounting plate, or to an optional cover plate fitted over the mounting plate. Similar to the second embodiment, the actuator button controls the anti-rotation feature which arrests or allows the rotation of the pin arm and socket arm about the support column. However, in this embodiment, the actuator button also controls the engagement of a fore-aft restrain system. In this embodiment, the actuator button causes the arm gear to position the torque bar between a restrained and unrestrained configuration. When the torque bar is in the restrained configuration, the torque bar engages the pivot attachment's aperture, arresting motion of at least one pivot attachment along the slot in the mounting plate. When the torque bar is placed into the unrestrained configuration, the torque bar disengages from the aperture of the pivot attachment, allowing both pivot attachments to move along said slot. Thus, in this embodiment, the actuator button controls the rotation of the mounting plate about the support column, the lateral motion of the mounting plate side to side, and the fore-aft motion of the armrest assembly along the slot. This improvement allows the armrest assembly to become positionable in at least three degrees of freedom when the actuator button is positioned in a first orientation, and causes the armrest assembly to be restrained in the same degrees of freedom when the actuator button is placed into a second orientation.

BRIEF DESCRIPTION OF THE DRAWING FIGURES

Other advantages of the present invention will be readily understood by reference to the following detailed description in connection with the accompanying drawings wherein.

Figure 14:
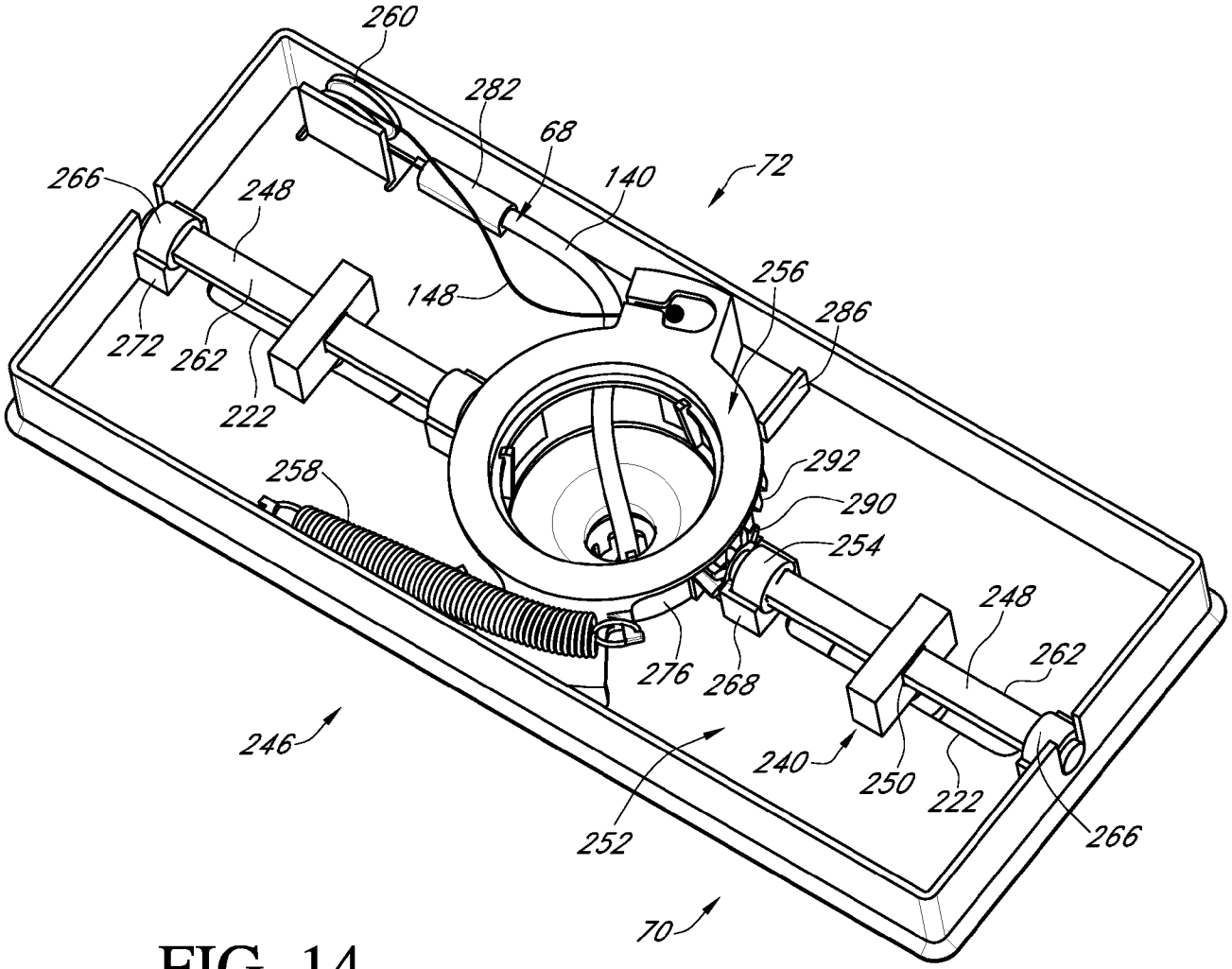
FIG. 14 is a perspective view of the first form of the upper mechanism of FIG. 11 fitted with an arm gear, a cable assembly and a return spring.
Figure 15:
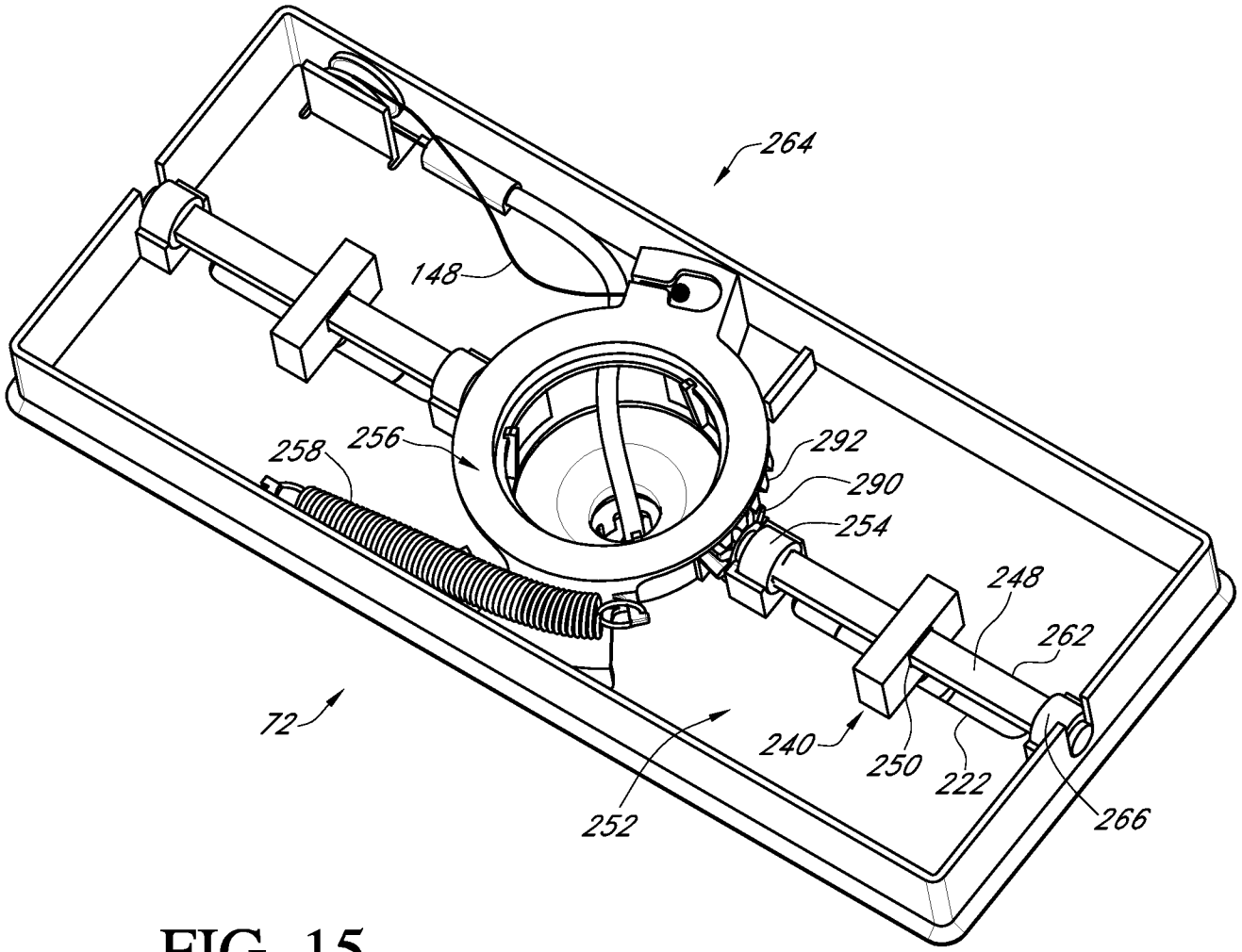
Figure 16:
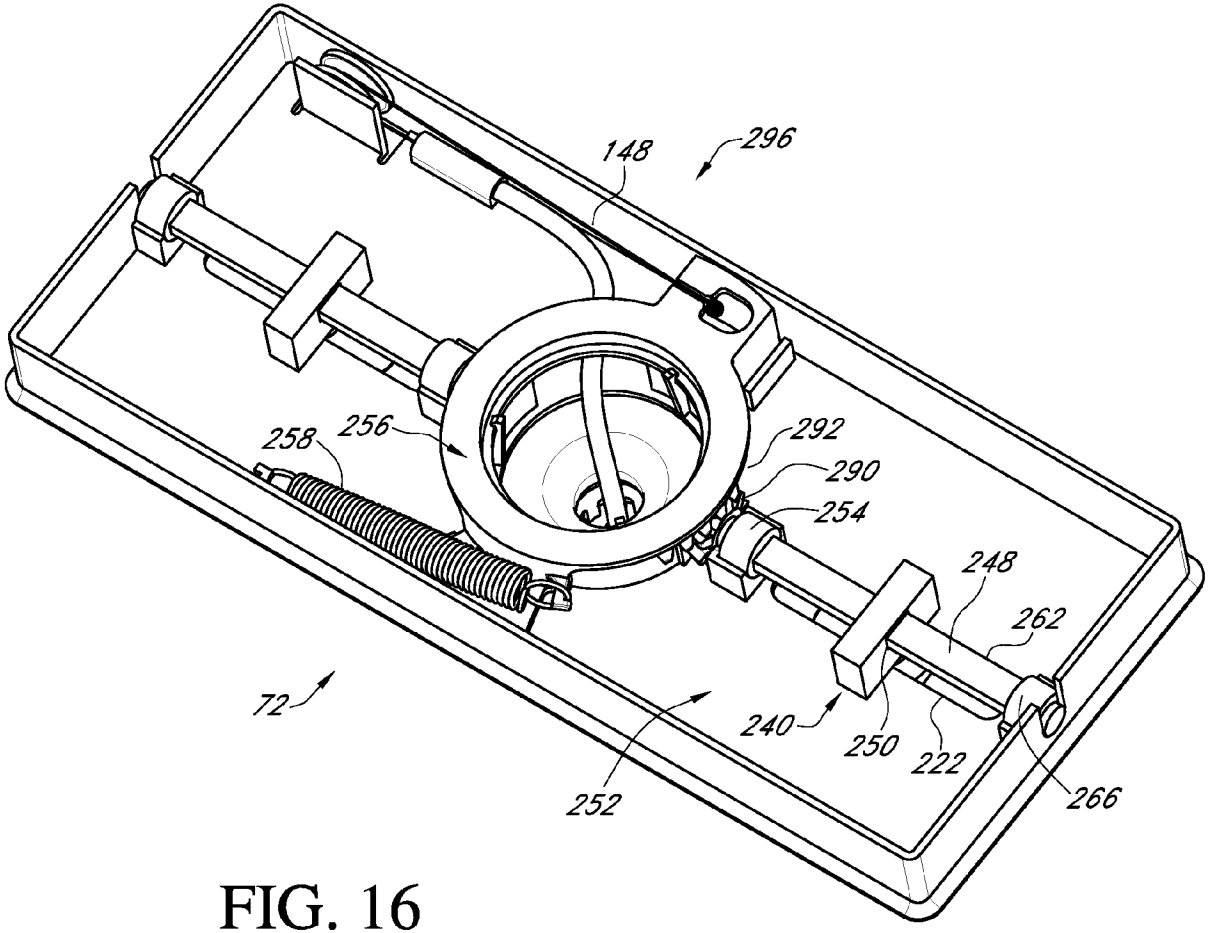
Figure 17:
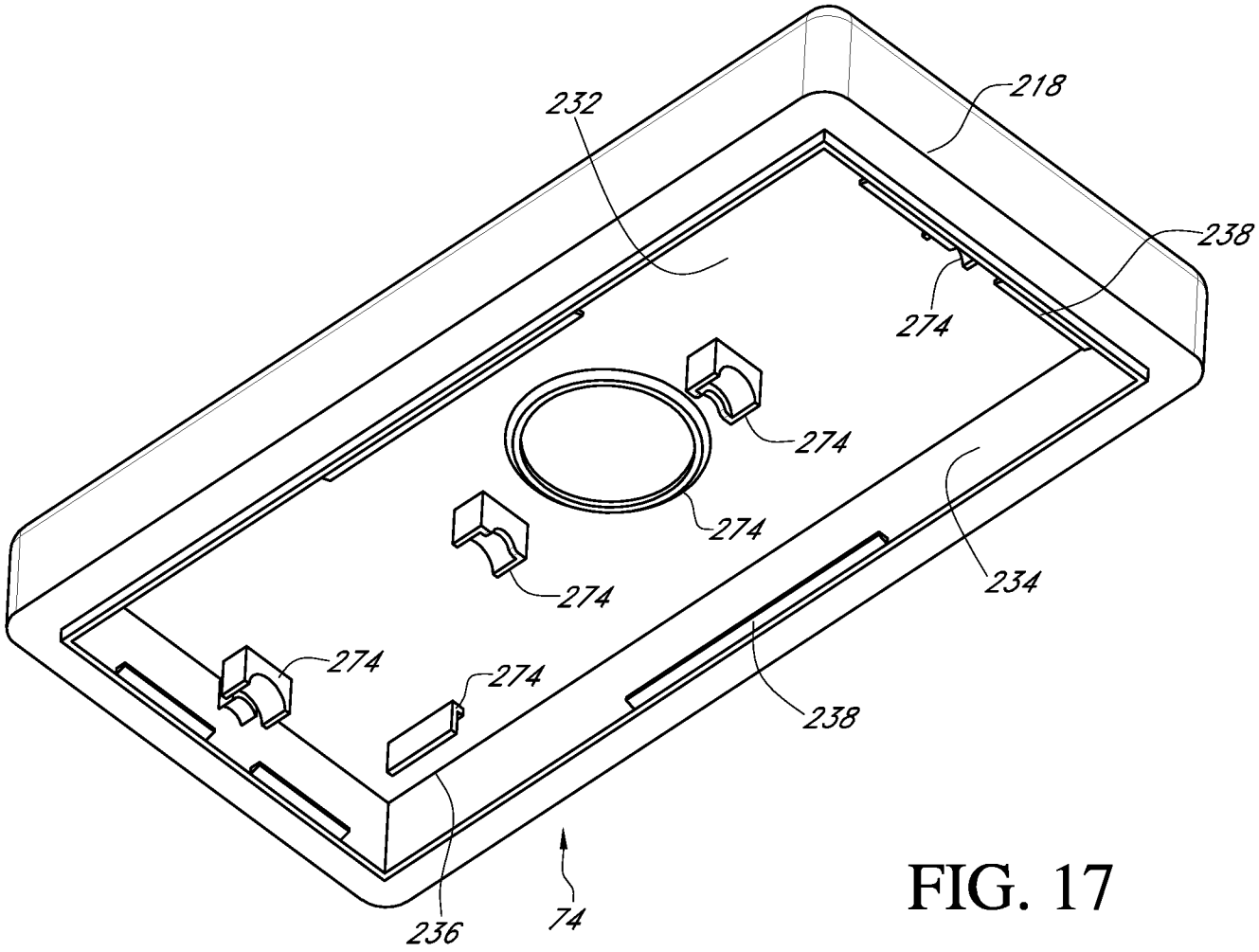
Figure 18:
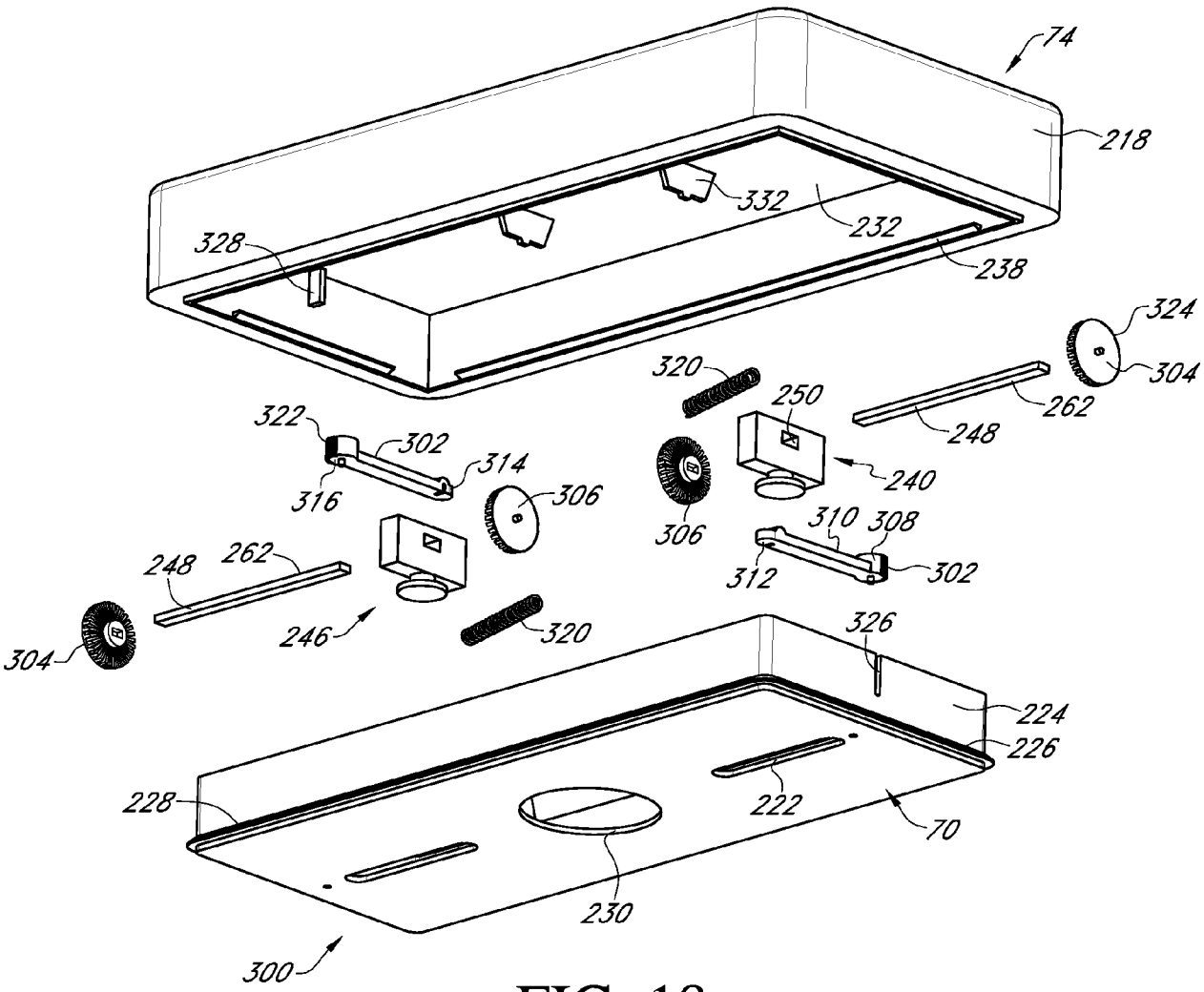
Figure 19:
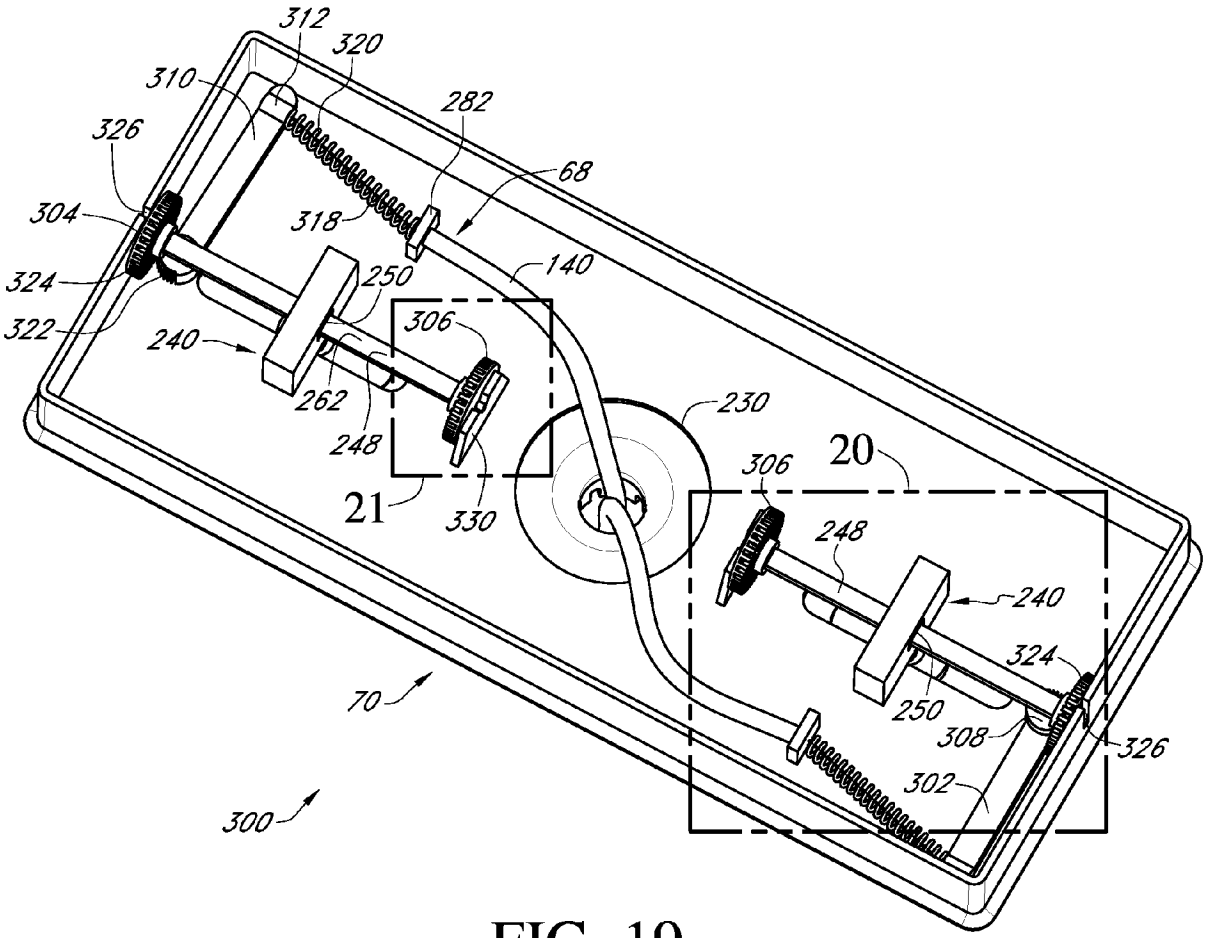
Figure 20:
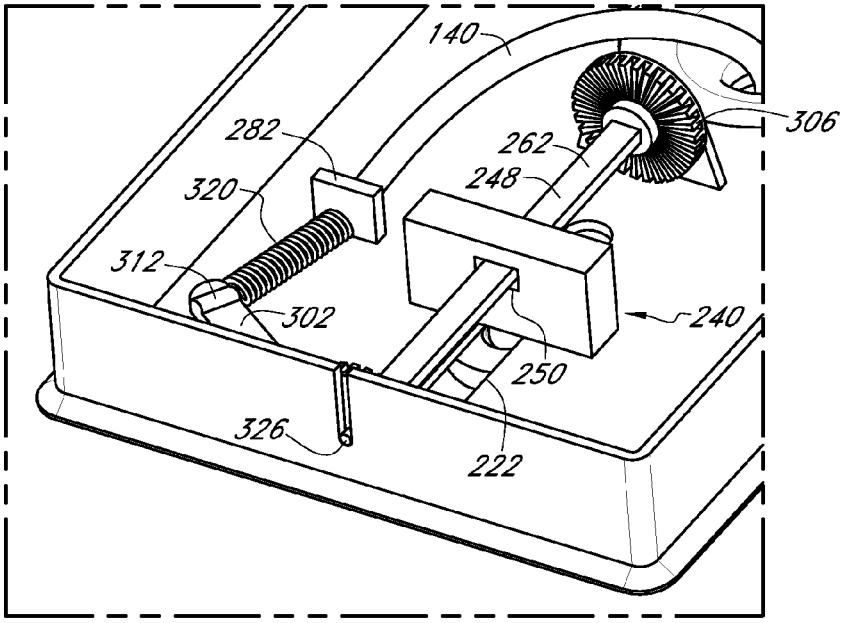
Figure 21:
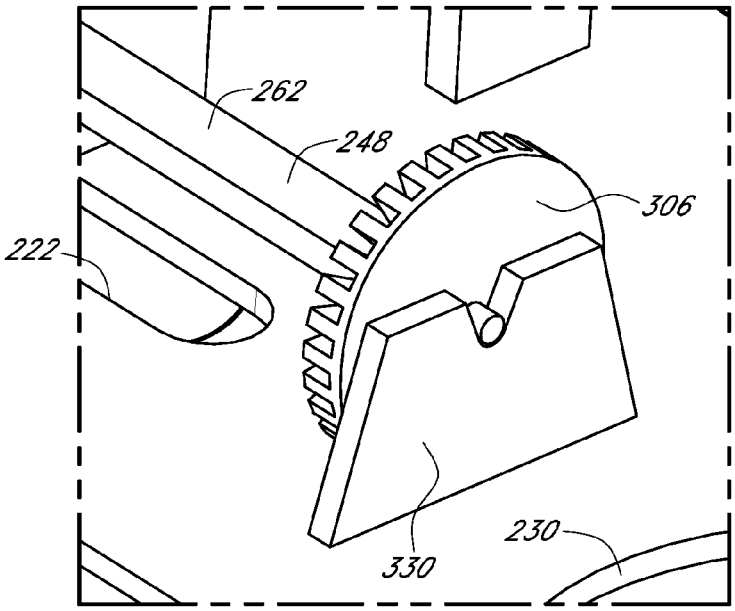
Figure 22:
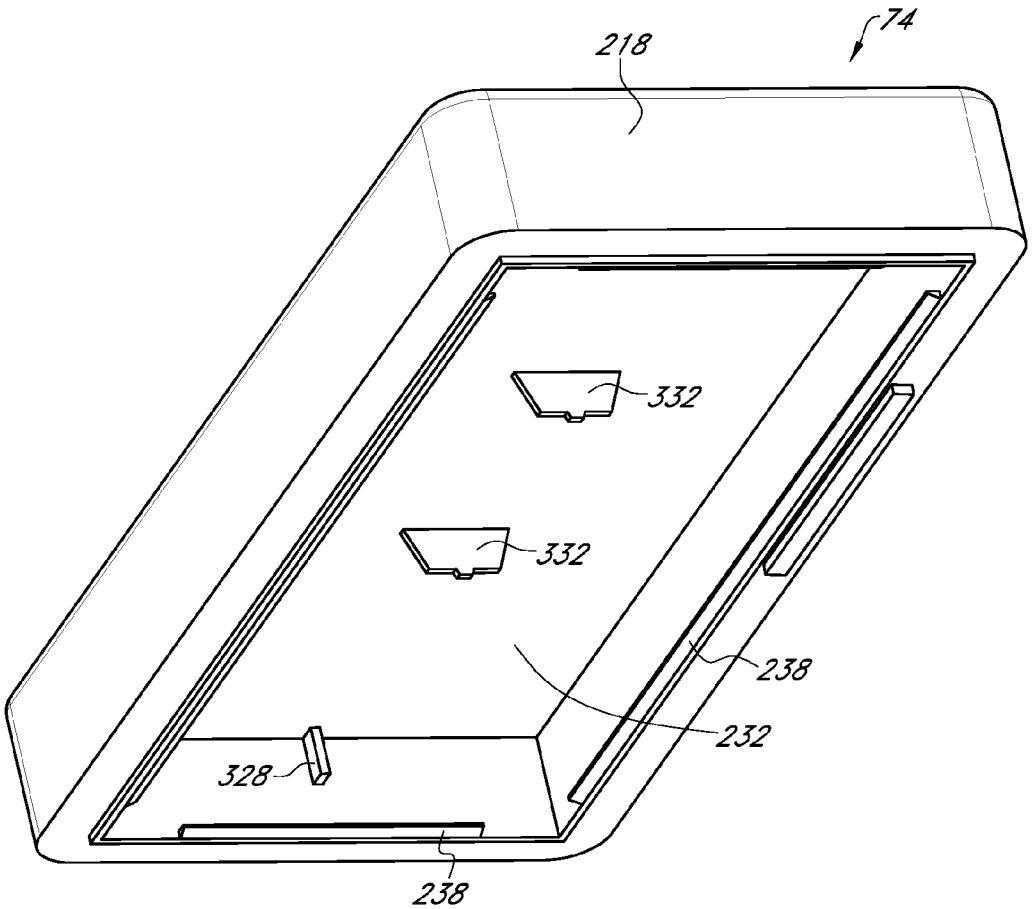
Figure 23:
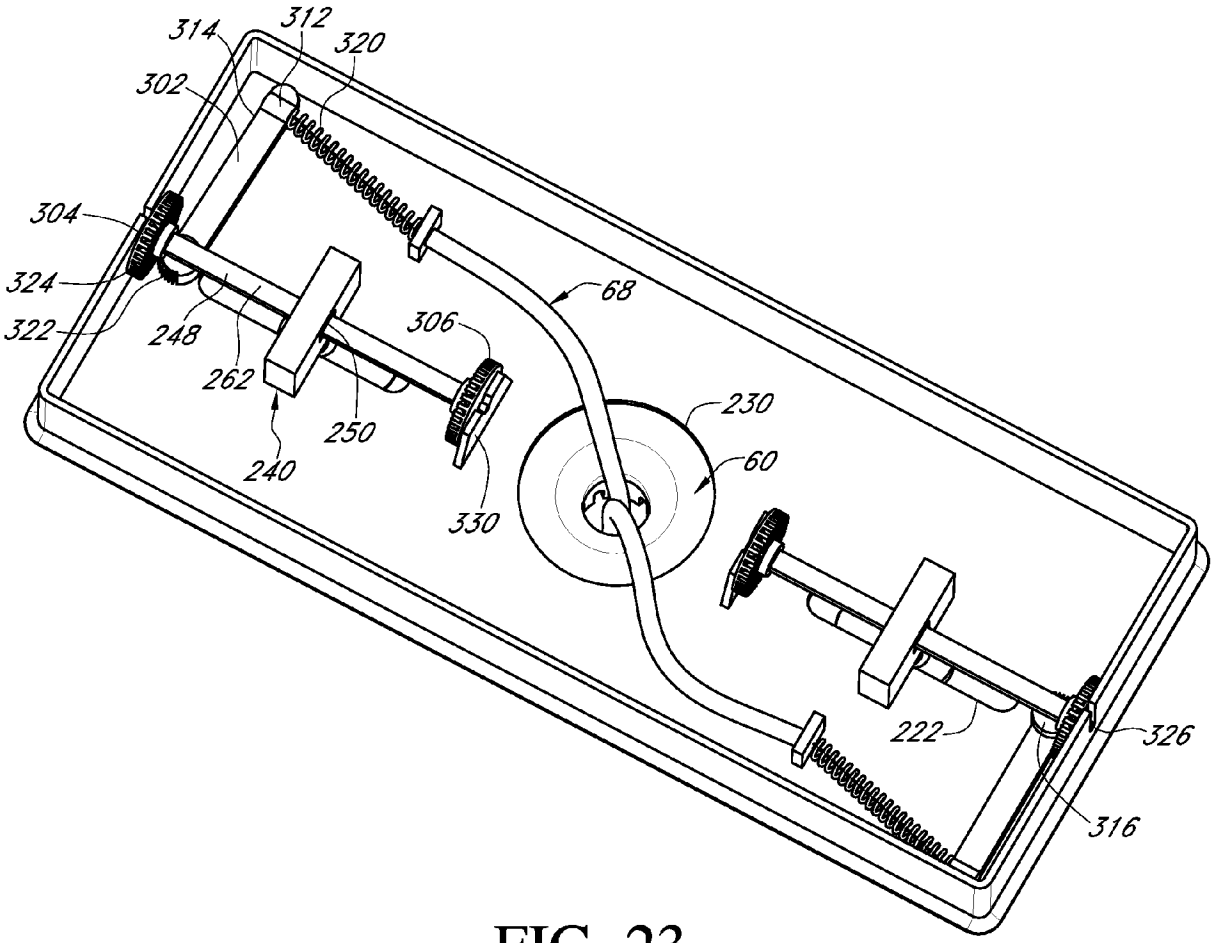
Figure 24:
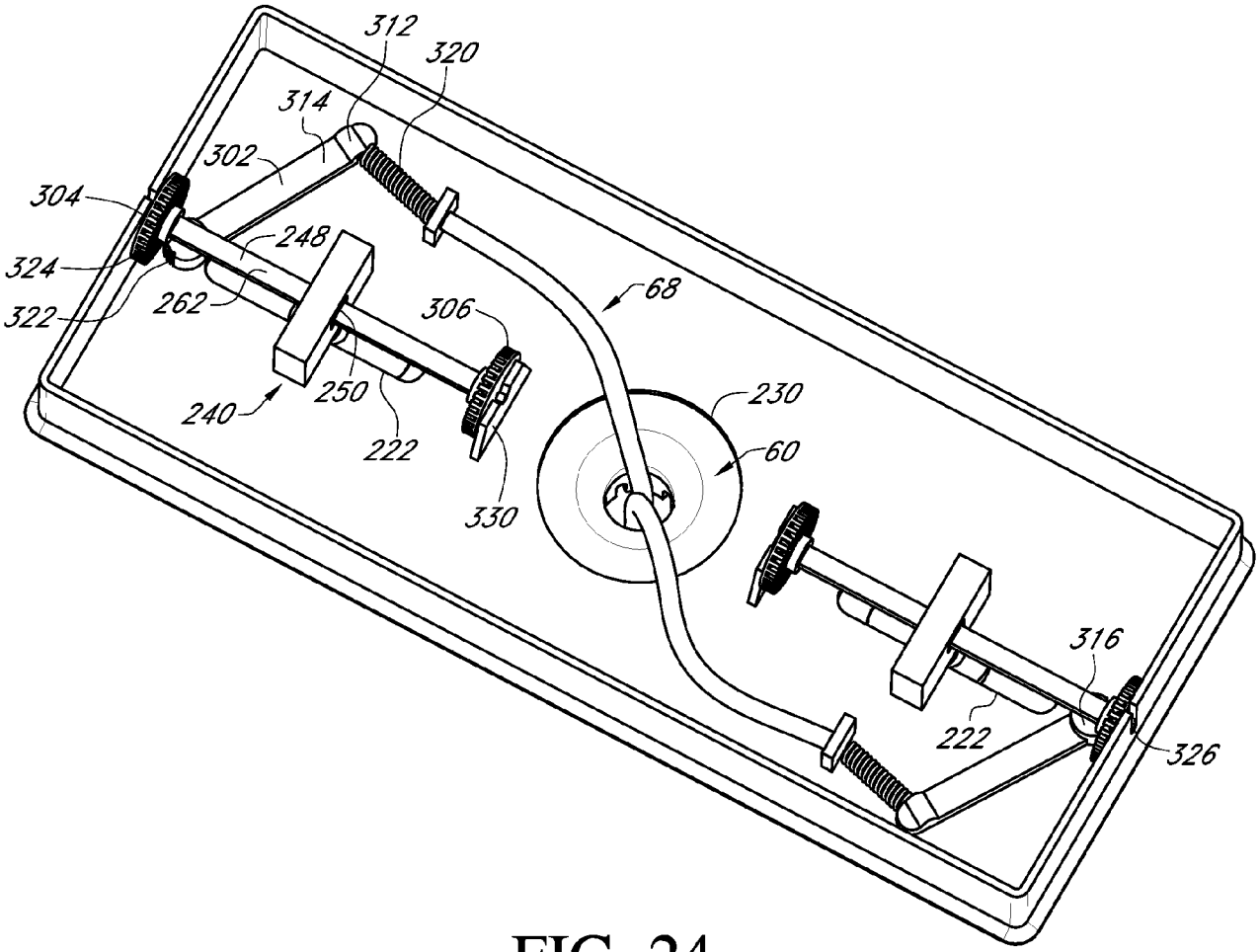
Figure 26:
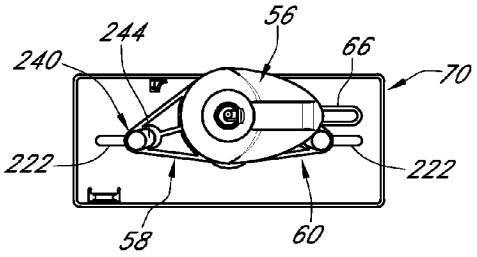
Figure 25:
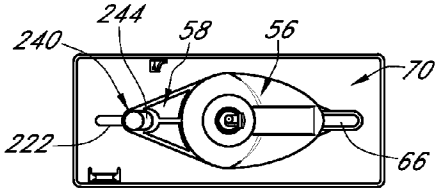
Figure 27:
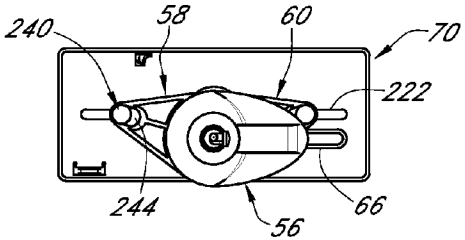
Figure 29:
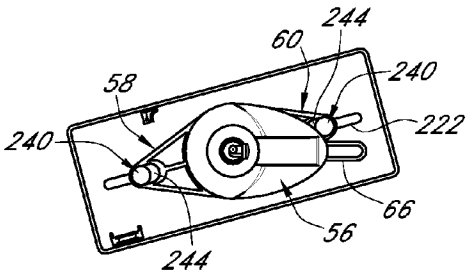
Figure 28:
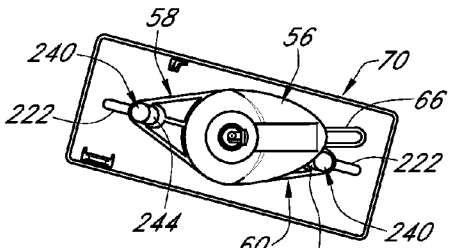
Figure 31:
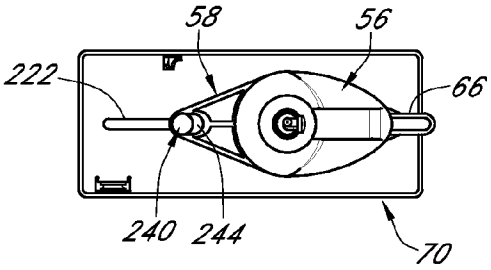
Figure 33:
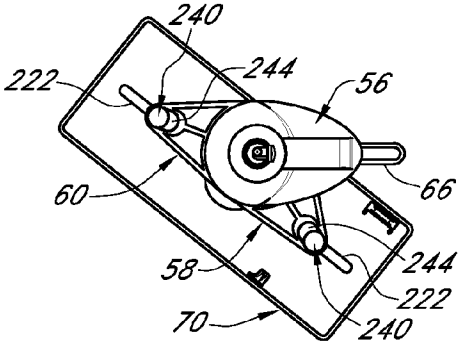
Figure 30:
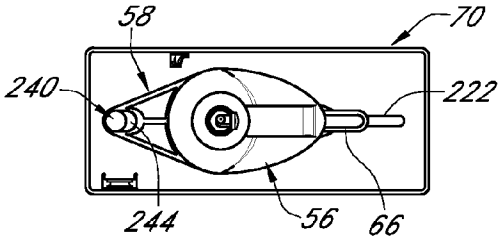
Figure 32:
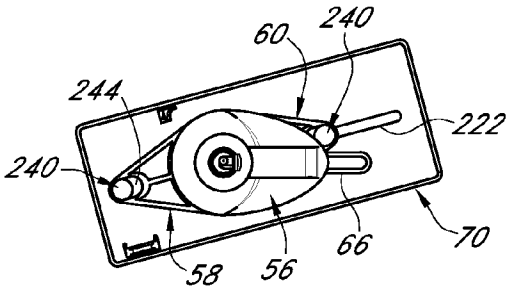

FIG. 15 a perspective view of the first form of the upper mechanism of FIG. 14 showing the first form of the fore-aft retention system in a disengaged configuration;

FIG. 16 a perspective view of the first form of the upper mechanism of FIG. 14 showing first form of the fore-aft retention system in an engaged configuration;

FIG. 17 is a perspective view of an upper cover for use with the first form of the upper mechanism;

FIG. 18 is an exploded view of the second form of the upper mechanism;

FIG. 19 is a perspective view of the second form of the upper mechanism showing the second form of a fore-aft retention system comprising a cable assembly, a torsion bar, an alternate swivel, an alternate torque gear, a pivot attachment, and a lever arm;

FIG. 20 is a detail view of area 20 in FIG. 19 showing a torsion bar fitted to a pivot attachment, and an alternate torque gear fitted to a slot in a wall in an alternate mounting plate;

FIG. 21 is a detail view of area 21 in FIG. 19 showing the alternate swivel fitted to a support in the mounting plate;

FIG. 22 shows a perspective view of an alternate cover;

FIG. 23 shows the second form of the fore-aft retention system of FIG. 19 in an engaged configuration;

FIG. 24 shows the second form of the fore-aft retention system of FIG. 19 in a disengaged configuration;

FIG. 25 is a bottom view of the first form of the armrest assembly positioned into a neutral position;

FIG. 26 is a bottom view of the first form of the armrest assembly positioned into a lateral left position;

FIG. 27 is a bottom view of the first form of the armrest assembly positioned into a lateral right position;

FIG. 28 is a bottom view of the first form of the armrest assembly rotated clockwise;

FIG. 29 is a bottom view of the first form of the armrest assembly rotated counterclockwise;

FIG. 30 is a bottom view of the first form of the armrest assembly positioned into a fore position;

FIG. 31 is a bottom view of the first form of the armrest assembly positioned into an aft position;

FIG. 32 is a bottom view of the first form of the armrest assembly rotated counterclockwise and positioned into a fore position; and FIG. 33 is a bottom view of the first form of the armrest assembly rotated more than 90° counterclockwise and positioned into a lateral right position.

DESCRIPTION OF THE VARIOUS EMBODIMENTS

Figure 1:
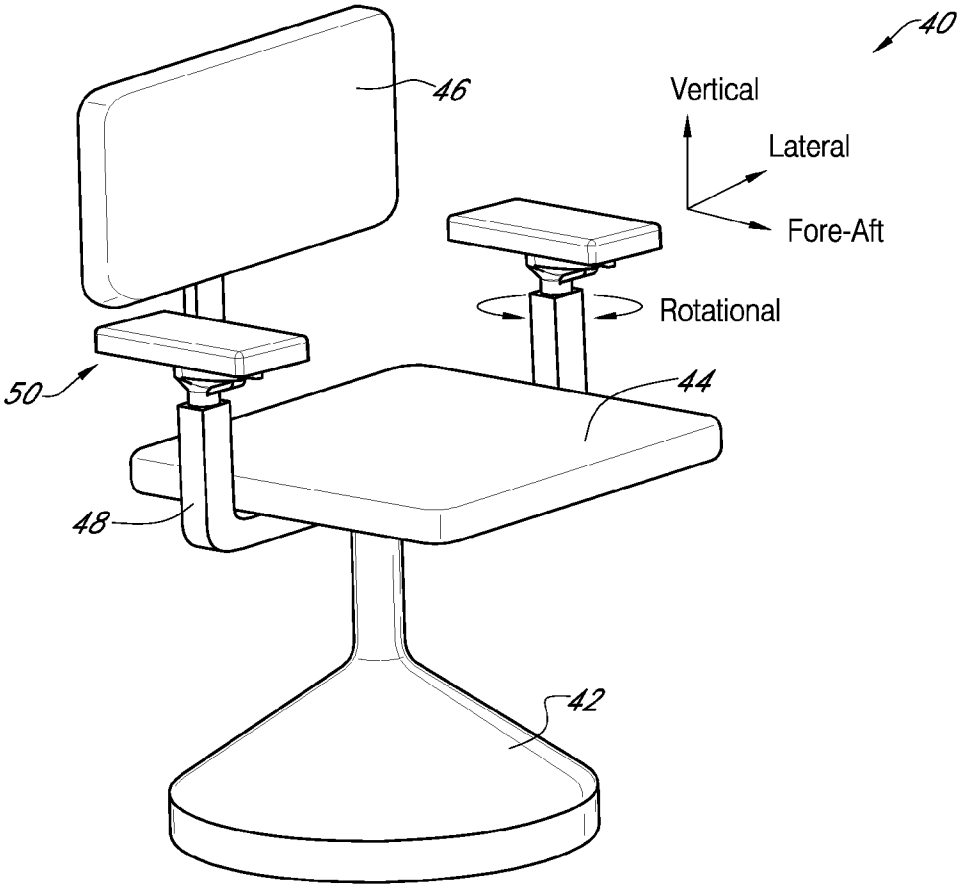
FIG. 1 is a perspective view of a chair.

For purposes of the following description, the terms "upper (positive vertical)," "lower (negative vertical)," "fore," "aft," "clockwise," "counterclockwise," "lateral left," "lateral right" and derivatives of such terms shall relate to the invention as oriented in FIG. 1 which is its Neutral orientation (i.e. FIG. 25.) However, it is to be understood that the invention may assume various alternative orientations and configuration, except where expressly specified to the contrary. It is also to be understood that the device illustrated in the attached drawings, and described in the following specification are simply exemplary embodiments of the inventive concepts described herein. Specific dimensions and other physical characteristics relating to the embodiments disclosed herein are not to be considered as limiting unless expressly stated otherwise. Further, the materials described herein are merely exemplary materials suitable for use with the invention and are not intended to be limiting. Hence, the materials described herein may be substituted with any other suitable material such as ferrous or non-ferrous metals, or alternate plastic compositions, including combinations of the above such as plastic components having metallic inserts.

An embodiment of a chair 40 is shown in FIG. 1 and comprises a frame 42, a seating surface 44, a chair back 46, an armrest support 48, and an adjustable armrest assembly 50. The armrest support 48 is attached to the chair's frame 42, and is adapted to receive the adjustable armrest assembly 50. The armrest support 48 may additionally contain a vertical height retention mechanism (not shown) which controls the elevation of the adjustable armrest assembly 50 relative to the seating surface 44.

Figure 2:
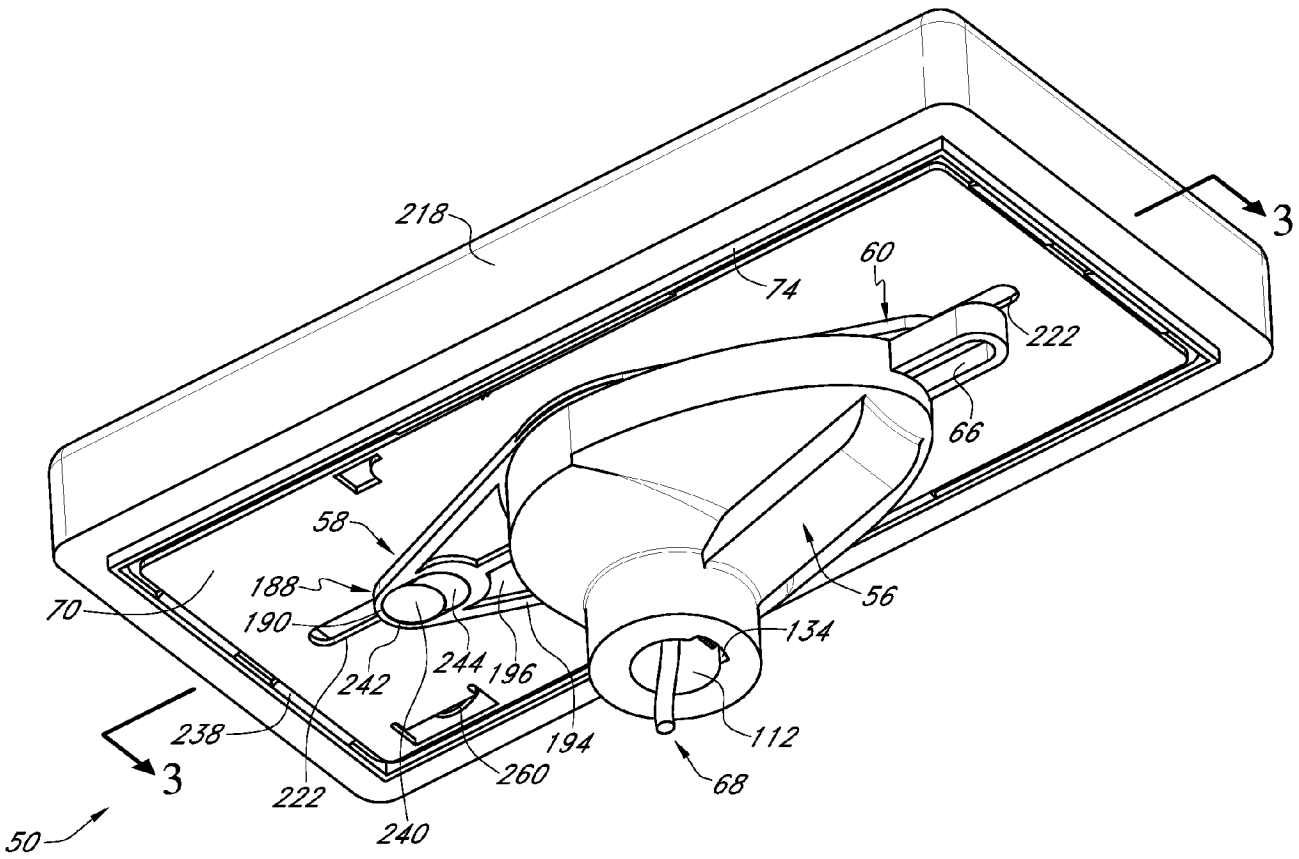
FIG. 2 is a perspective view of an adjustable armrest assembly.
Figure 3:
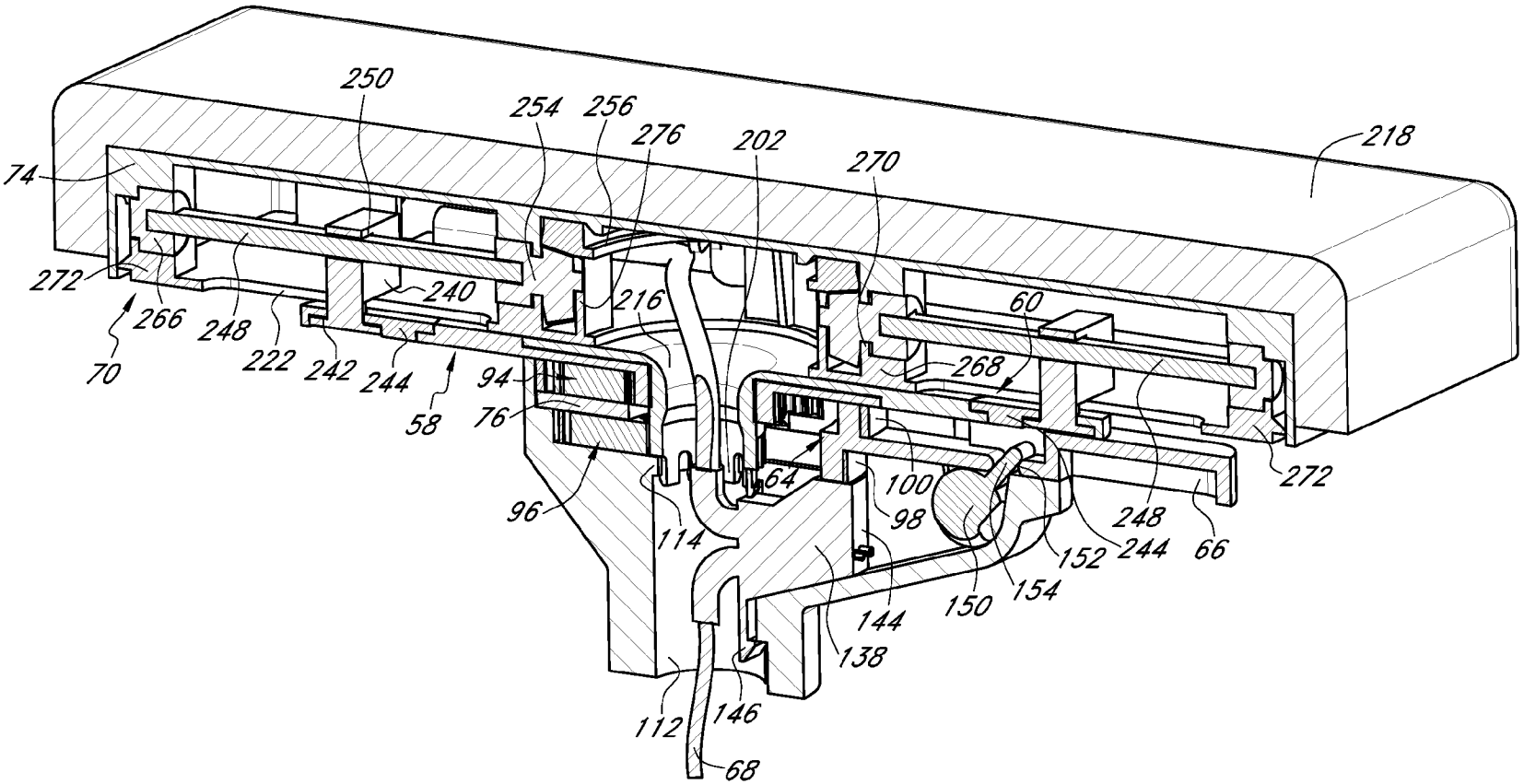
FIG. 3 is a cross sectional view taken along section line 3 of FIG. 2.
Figure 4:
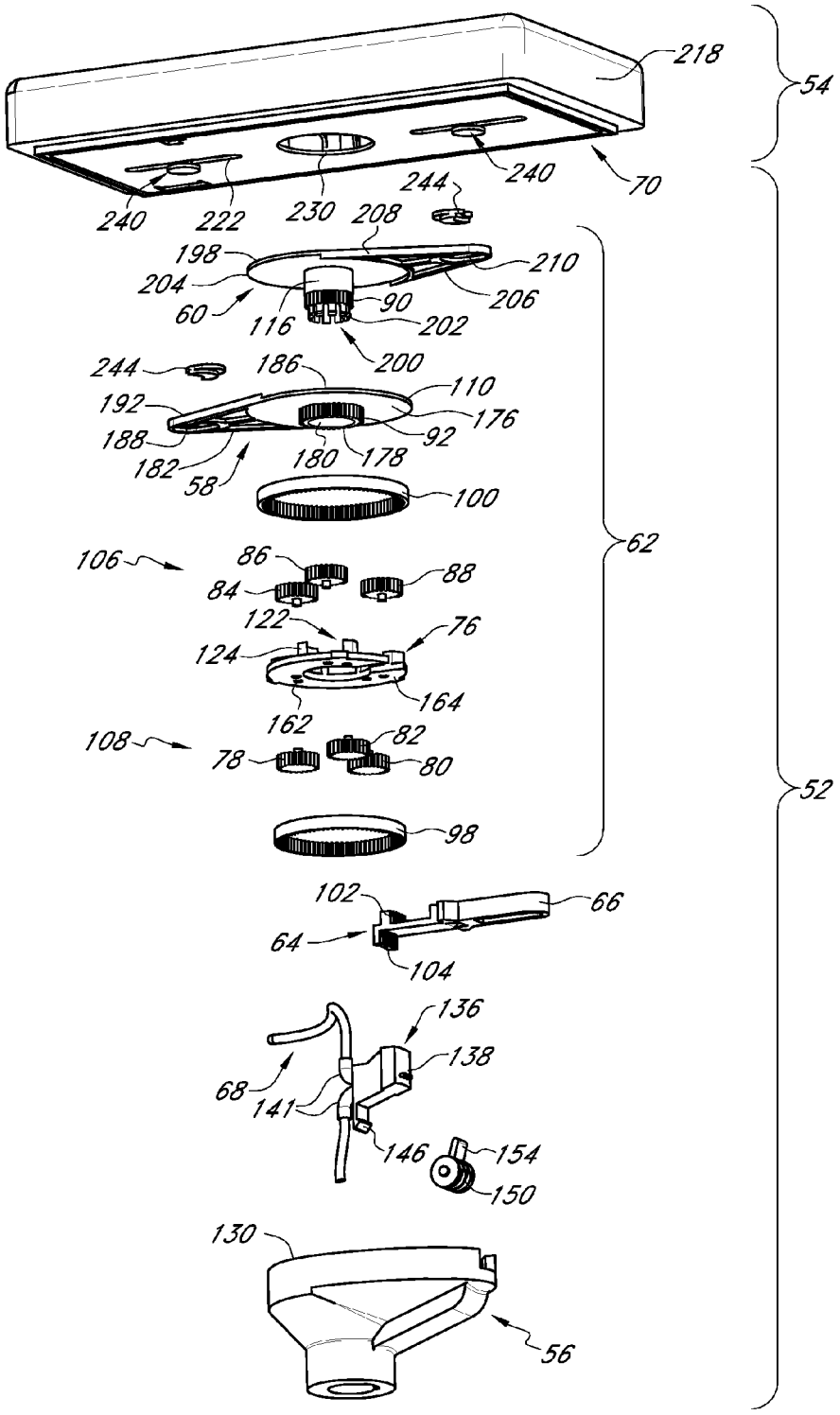
FIG. 4 is a partially exploded view of the adjustable armrest assembly shown in FIG. 2 showing an assembled upper mechanism and an exploded lower mechanism.

One form of the adjustable armrest assembly 50 is shown in FIG. 2, in cross section in FIG. 3, and in an exploded assembly view in FIG. 4. This assembly comprises a lower mechanism 52 and an upper mechanism 54 working in conjunction to allow a user of the adjustable armrest assembly 50 to position the assembly in at least two, and preferably three, degrees of freedom. If a vertical height retention mechanism is also included in the armrest support 48, the adjustable armrest assembly 50 will also operate this mechanism allowing the assembly to be adjustable in at least four degrees of freedom. Further, the assembly may be configured to retain its position, thereby improving the ergonomics of the armrest assembly over that of the prior art.

In the embodiment shown in FIG. 4, the lower mechanism is further comprised of a support column 56, a socket arm 58, a pin arm 60, an epicyclic gearset 62, an anti-rotation feature 64, an actuator button 66, and a cable assembly 68. The upper mechanism 54 comprises a mounting plate 70, an optional fore-aft retention system 72, and a cover 74. The engagement of the lower mechanism's anti-rotation feature 64 and the upper mechanism's fore-aft retention system 72 are preferably controlled through the position of the lower mechanism's actuator button 66. When the actuator button is depressed, the anti-rotation feature disengages and frees the epicyclic gearset 62. This in turn allows lateral movement left and right, as well as rotation clockwise and counterclockwise. Additionally, depression of the actuator button releases the optional fore-aft restraint system 72, which allows for movement of the upper mechanism both fore and aft.

Epicyclic gears, or planetary gears, are a system of gears comprising one or more planet gears, revolving about a central, or sun gear. Epicyclic gearing systems may also incorporate the use of an outer ring gear, or annulus, which meshes with the planet gears and creates a gearing ratio between the sun, the planets, and annulus. In many epicyclic gearsets, the planet gears are permitted to revolve about the sun gear, and are spaced equidistantly from one another by a planetary carrier, which may also rotate about the sun. In the first embodiment depicted in FIGS. 2 through 16 the planetary carrier is held stationary, allowing the motion of the sun gear to be transmitted through the planetary gears to the annulus. In this embodiment, the axes of all gears are depicted as being vertically parallel; however they may also be placed at an angle by introducing a bevel to the gears. Further, the sun, planet carrier and annuli's central axes are depicted as being coaxial, though they do not necessarily need to be. Also, it is further anticipated that the system may include complex planetary gear arrangements having one or more additional planet gears in contact with one other (e.g. sun, planet, planet, annulus), further modifying the gearing ratio.

Figure 5:
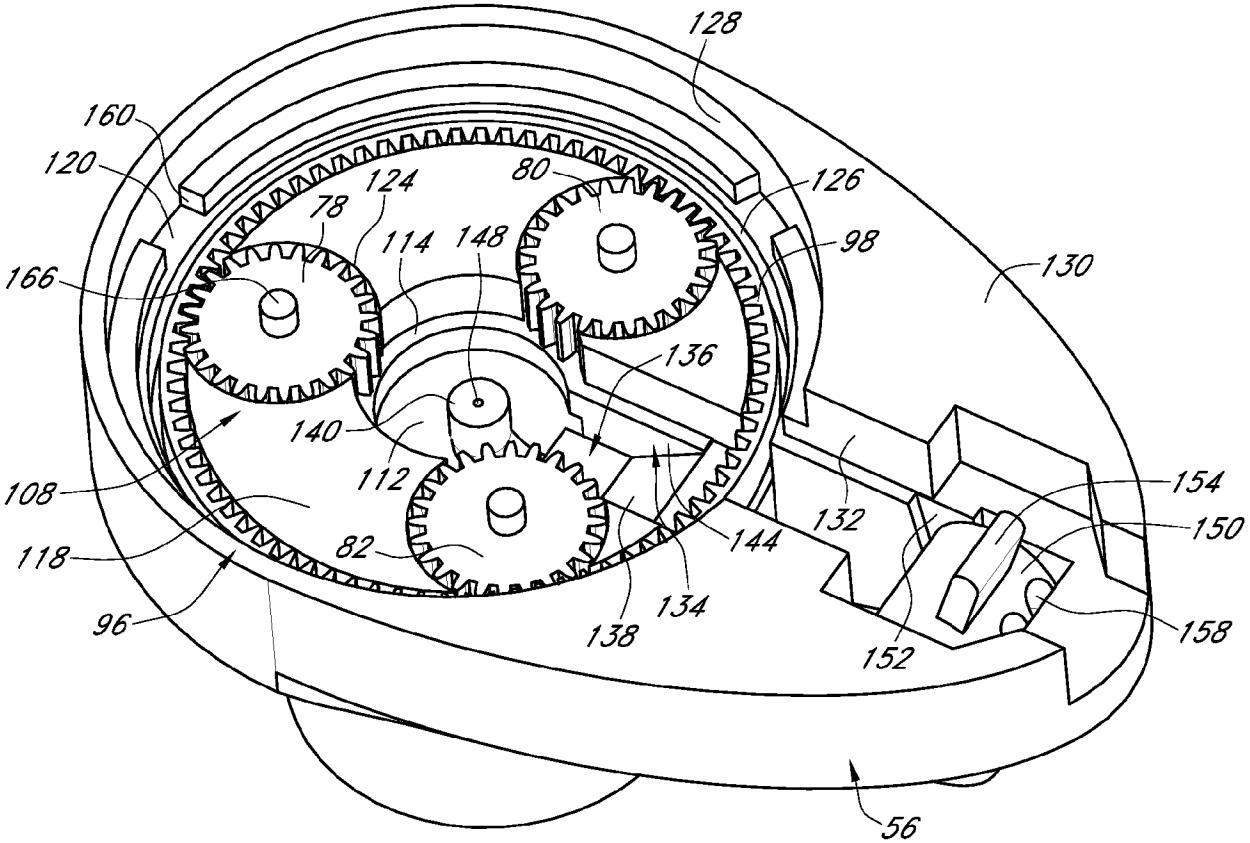
FIG. 5 is a perspective view of a partially assembled lower mechanism showing a first set of planetary gears, a first annulus gear, a cable housing, and a button wheel installed into a support column.
Figure 6:
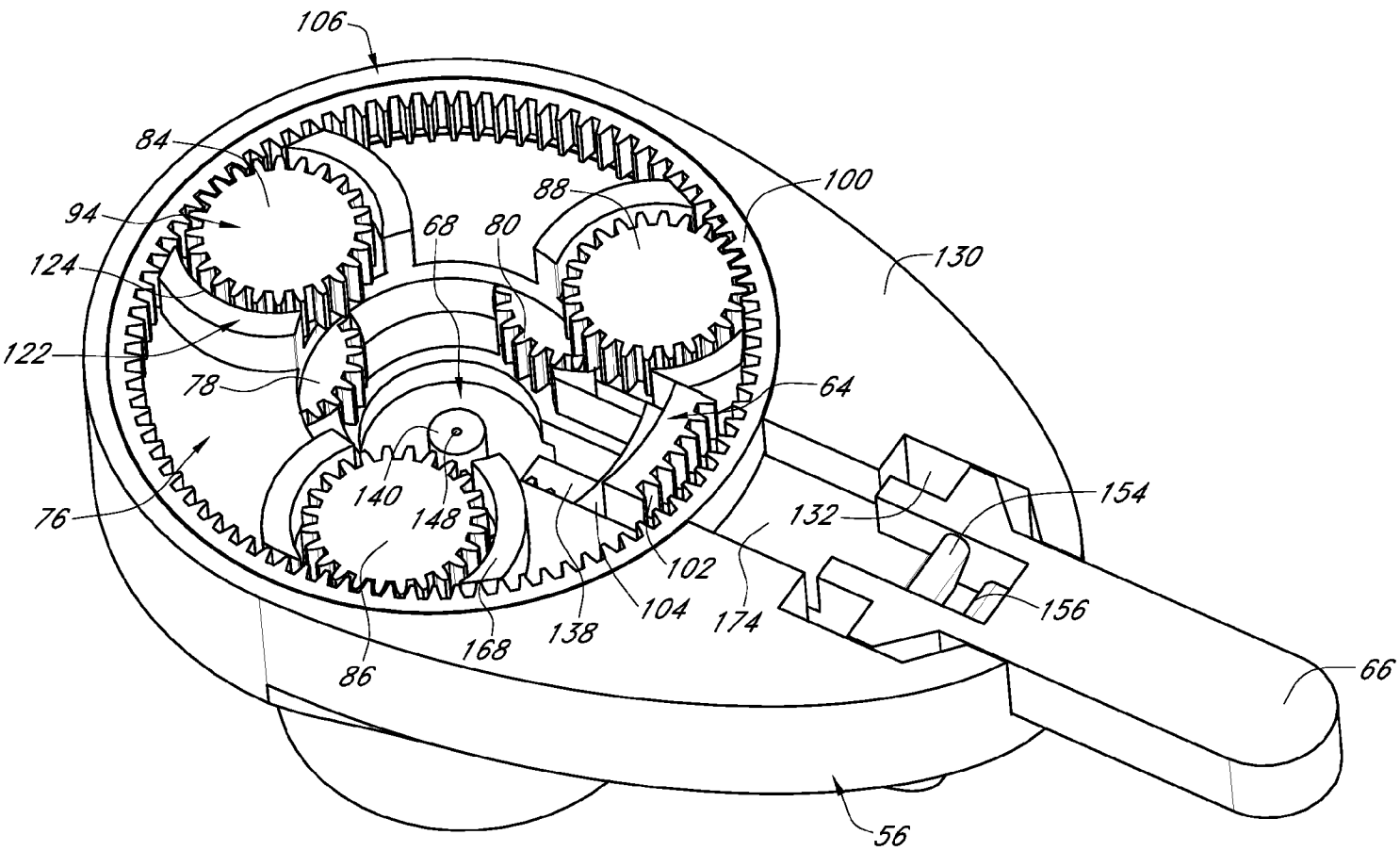
FIG. 6 is a perspective view of a partially assembled lower mechanism showing a planetary carrier, a second set of planetary gears, a second annulus gear, and button with an attached anti-rotation feature installed into the support column of FIG. 5.
Figure 8:
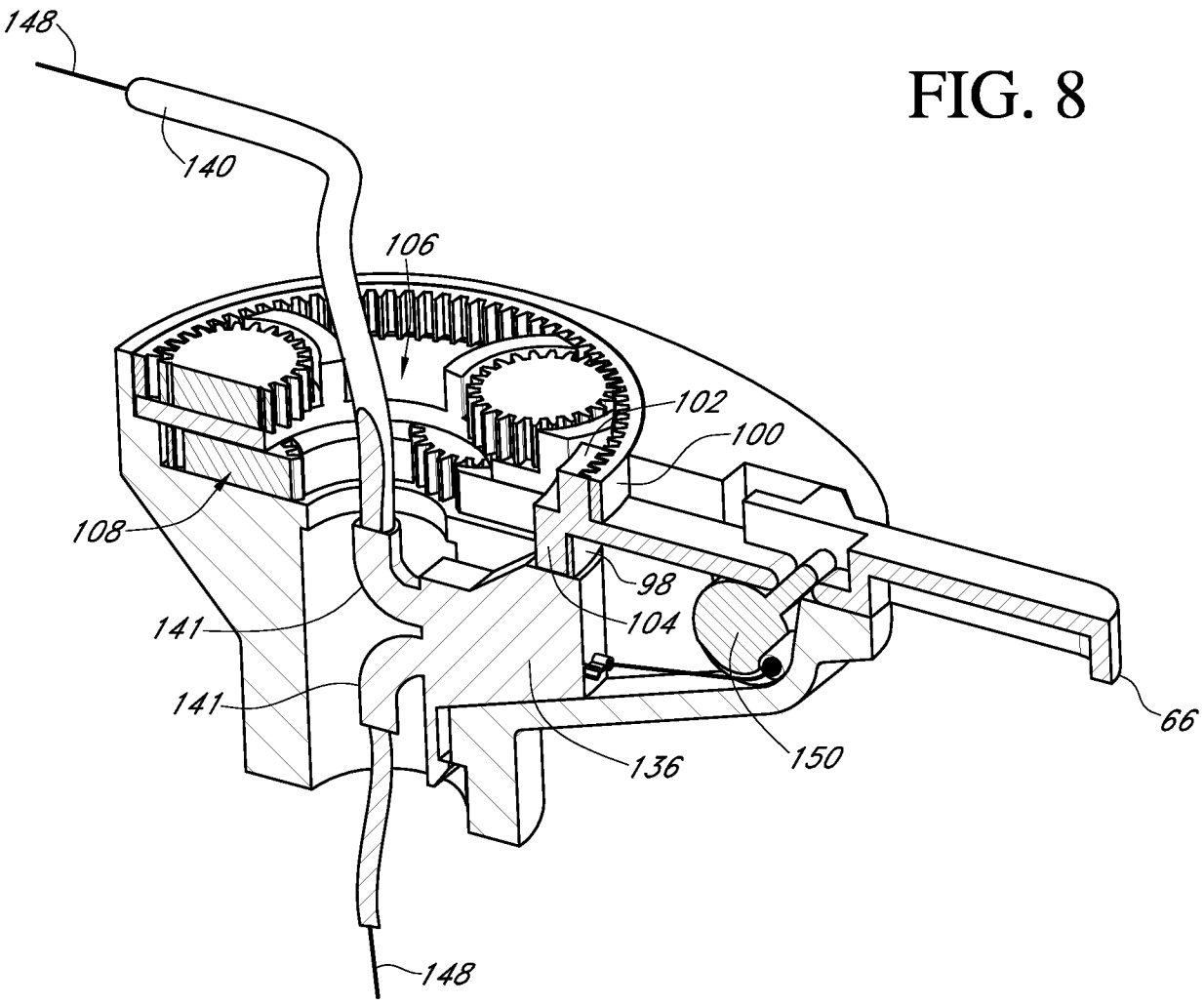
FIG. 8 is a cross sectional view taken along section line 3 of FIG. 2 showing the anti-rotation feature engaging a portion of the first and second epicyclic gearsets.
Figure 9:
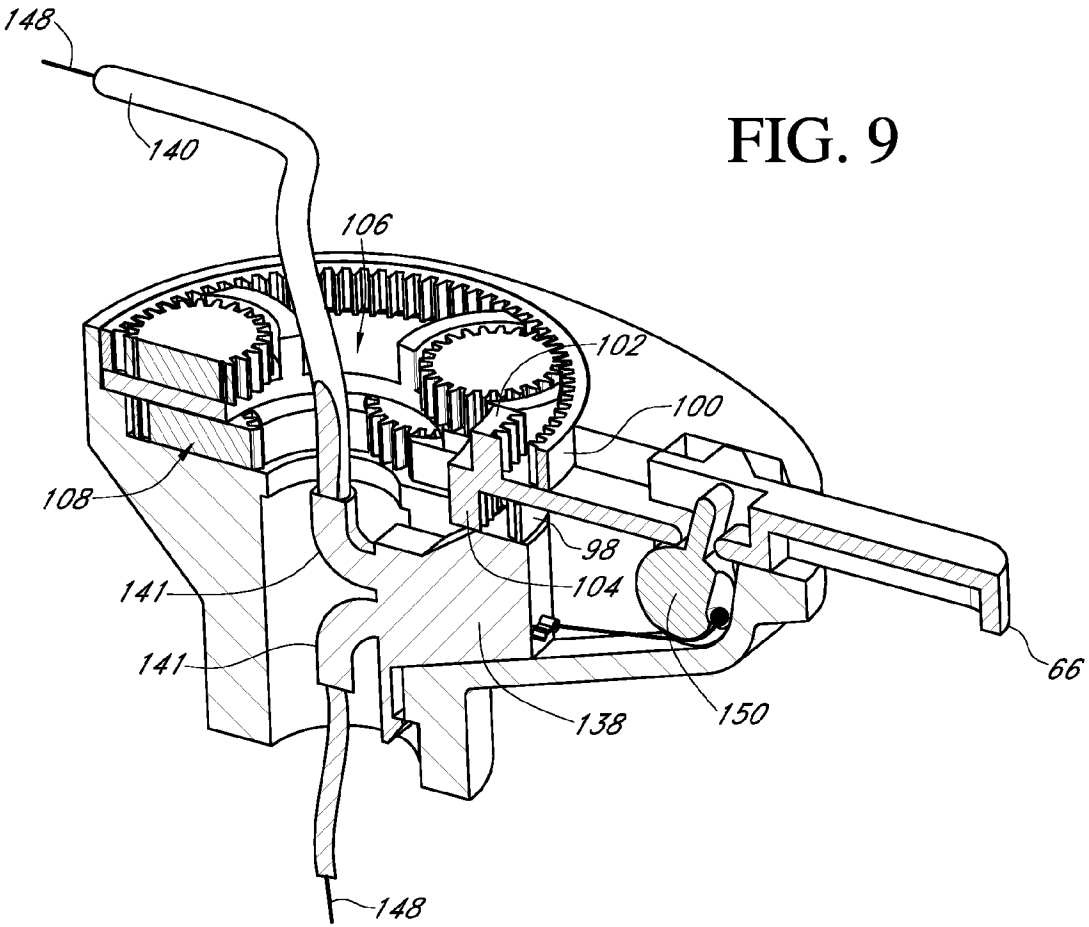
FIG. 9 is a cross sectional view taken along section line 3 of FIG. 2 showing the anti-rotation feature disengaged from the first and second epicyclic gearsets.

In the embodiment of the invention shown in FIGS. 2 through FIG. 16, and best shown in FIGS. 5 and 6, a planetary carrier 76 is fixed in position inside the support column 56, preventing the individual planet gears (78, 80, 82, 84, 86, 88) from orbiting the sun gears (90, 92). This planetary carrier 76 separates the upper and lower planetary gearsets (94, 96). In this version of the system, the motion of the sun gears (90, 92) is transmitted through the set of planetary gears (94, 96) and into the annulus gears (98, 100). Since the planetary carrier 76 is fixed, if any other component of this system is further restrained, the motion of the remaining components is arrested. Thus motion in the epicyclic gear set 62 can be controlled by applying a device with an anti-rotation feature 64 against any of the surfaces of the epicyclic gear set 62 arresting its rotation. However, the force necessary to restrain the rotational motion varies according to the force's input location on the epicyclic gearset, and the elements which are restrained. Therefore, concerning rotation of the sun gears (90, 92), it is preferred to restrain motion of the annulus (98, 100) in order to obtain the maximum mechanical advantage of the system. The preferred form of the anti-rotation feature 64 is a set of gear teeth (102, 104) which engage the toothed surfaces of the gearset and preferably the annuli (98, 100). This engagement is best shown in FIGS. 8 and 9.

In the embodiment shown in FIG. 4, the adjustable armrest assembly 50 has two rotational members (pin arm 60, and socket arm 58). The epicyclic gearset 62 is preferably comprised of two separate gearsets, an upper deck 106 and a lower deck 108. Each deck corresponds to the motion of one of the arms (58, 60). Accordingly, the lower deck 108 comprises a lower annulus 98, at least one lower planet (78, 80, 82), and a lower sun gear 90 located on the pin arm 60. The upper deck 106 comprises an upper annulus 100, at least one upper planet (84, 86, 88), and an upper sun gear 92 located on the socket arm 58. The position of the lower planets (78, 80, 82) are constrained by their placement in the support column 56, and by the fixed planetary carrier 76, while the upper planets are constrained by the fixed planetary carrier 76 and the lower surface 110 of the socket arm 58. In the preferred form of this embodiment, each deck (106, 108) comprises three planetary gears of equal size, spaced equidistantly from one another, each engaging their respective annuli (98, 100) and their respective sun gear (90, 92).

One embodiment of the support column 56, best shown in FIG. 3, comprises a central through hole 112 having a retention lip 114 sized to receive and retain the pin arm's main shaft 116. As shown in FIG. 5, the column further has a first counterbore 118 creating a carrier support surface 120. Additional cutouts 122 are placed into the carrier support surface 120, and include one or more planetary gear recesses 124. An annulus groove 126 is also added, preferably concentric with the through hole 112. Each of the cutouts is sized to accommodate their respective component of the lower deck 108 of the epicyclic gearset 62. A second larger counterbore 128 is then placed above the first counterbore 118 and is sized to receive the upper annulus 100 from the upper deck 106.

In a preferred form of the support column 56, the second counterbore 128 is preferably located concentric to both the first counterbore 118 and the through hole 112. The second counterbore 128 is preferably of sufficient depth to allow the entirety of the upper annulus 100 to fit flush to, or beneath the top surface 130 of the column. (See FIG. 6.) An actuator button cutout 132 is then placed into the support column 56 so that it intersects a portion of the first and second counterbore (118, 128) and passes to an outside surface of the support column. This allows a button 66 and an anti-rotation feature 64 to be placed into the actuator button cutout 132 and access a portion of the upper and lower annuli (98, 100). In the preferred form, the actuator button 66 is attached to and operates the anti-rotation feature 64.

A cable retention cutout 134 may also be placed into the support column 56, preferably adjacent to the central hole 112. This cable retention cutout 134 allows one or more cable retention features 136, such as a cable housing 138 to be installed. The cable housing 138 is then used to organize and retain the outer jacket 140 of an associated push-pull cable assembly 68 and may include metal guides 141 to prevent the cable from abrading the support column 56. In the embodiment of the invention shown in FIG. 5, the cable housing 138 is inserted into a slot shaped cutout 144 in the support column 56, which is sized to allow the cable housing 138 only to be inserted in a vertical direction. A snap locking feature 146 (See FIG. 4) is included on the base of the cable housing 138 so that when the cable housing is fully inserted in the support column 56 it will become anchored into place. A preferred material for the support column 56 is a 30% glass filled Nylon 6, however any other suitable material may be chosen which allows for sufficient rigidity. A preferred material for the cable housing 138 is a 30% glass filled Nylon 6, however any other suitable material may be chosen which allows for a one time deflection of the snap lock feature 146.

The inner member 148 of the cable assembly 68 is then attached to a cable button wheel 150 which is installed into another recess 152 in the support column 56. The button wheel 150 is permitted to pivot within the support column 56, and engages the button 66 via a lever arm 154 fitted to a receiving window 156 in the button 66. (See FIG. 6). The cable assembly's inner member 148 is attached to the cable button wheel 150 via a cable attachment feature 158 (See FIG. 5). This allows the inward motion of the button 66 to create a tension on the inner member 148 of the cable assembly 68, which is then routed through the cable housing 138 to operate other mechanisms within the arm rest assembly, including but not limited to the optional vertical adjustment and optional fore-aft retention systems detailed further herein. This allows an inward motion (or push) of the button 66 to actuate the mechanisms. However, the inner member 148 of the cable assembly 68 could be attached directly to the button 66 allowing the button to operate when placed under tension (pulled). In this instance, the button 66 may be replaced with a lever. A preferred material for the cable button wheel 150 and the actuator button 66 is a 30% glass filled Nylon 6, however any other suitable material may be chosen which allows for sufficient rigidity.

Starting in FIG. 5, the lower planetary gearset 96 and lower annulus 98 are fitted to the support column 56, and a fixed planetary carrier 76 is then placed atop the planetary gears retaining their position. In one preferred form of the invention shown in FIG. 6, the fixed planetary carrier 76 is placed adjacent to the carrier support surface 120 and is anchored in the support column 56, through one or more retention features 160 (FIG. 5) or via a press fit. The planetary carrier further comprises one or more axle holes 162 placed through its face 164 which are sized to receive and position the planetary gears by engaging an axle pin 166 on each planet (78, 80, 82, 84, 86, 88). These axle holes are best shown in FIG. 4 and aid in the positional retention of the planets in the upper deck 106, preventing the upper planetary gears (84, 86, 88) from rotating about the upper sun gear 92. Planetary gear support walls 168 (FIG. 6) may also be used to assist with the retention of the planetary gears and can act as a fail-safe should the planetary gear's axle pins 166 fail. Further, this arrangement allows for the use of a common planetary gear design in both the upper and lower decks (106, 108). A preferred material for annuli (98, 100) and the planetary gearsets (94, 96) are acetal plastic, while the planetary carrier (76) is preferably constructed of polypropylene. Any other suitable material may also be chosen, though a minimal amount of friction between the components is preferred.

Following installation of the lower planetary gearset, an anti-rotation feature 64 is then fitted to the support column 56 along with an actuator button 66. One embodiment of the anti-rotation feature is shown in FIG. 6 as a set of gear teeth (102, 104) attached to an end 174 of the actuator button 66. This anti-rotation feature 64 engages one or more of the epicyclic gearset's 62 gears and prevents their rotation. In one preferred form of the invention, the anti-rotation feature 64 engages both the upper annulus 100 and the lower annulus 98, preventing the rotation of the gears in the upper deck 106 and lower deck 108 simultaneously. (See FIGS. 8 and 9.) In this embodiment, the anti-rotation feature is shown attached to the actuator button 66, and is biased by a spring through the cable assembly 68 to cause the anti-rotation feature 64 to remain engaged with the epicyclic gearset 62 when the button is 66 released. Similarly, when the actuator button 66 is depressed and the force of the return spring is overcome, the anti-rotation feature 64 disengages from the epicyclic gearset 62, allowing the gearset to rotate. A preferred material for the actuator button 66 is a 30% glass filled Nylon 6, however any other suitable material may be chosen which is sufficiently rigid.

Once the actuator button 66 and anti-rotation feature 64 are installed, the upper planetary gears (84, 86, 88) and the upper annulus 100 are installed thereafter forming the upper planetary gearset (94) as is shown in FIG. 6. In one preferred form of the invention, the upper planetary gear's axle pins 166 are installed into the through axle holes 162 in the fixed planetary carrier 76. The upper planetary gearset 94 is then retained in position by capturing it between the fixed planetary carrier 76 and the lower surface 110 of the socket arm 58.

As shown in FIG. 4, the socket arm 58 comprises a base portion 176, which is preferably cylindrical 178 in shape. In a preferred form of the invention, the socket arm's base 176 has an upper sun gear 92 molded into its outer circumference, and has a through hole 180 sized to receive the pin arm's main shaft 116. The socket arm 58 further comprises a socket arm member 182, attached to the base 176 on a first end 186 and terminating in a pivot attachment mounting feature 188, such as a through hole 190 or a slot (not shown) located on a second opposite end 192. Structural ribs 194 and material saving cutouts 196 may also be included in the design to save on manufacturing costs. The socket arm 58 is then fitted to the support column 56, wherein the upper sun gear 92 engages the upper planetary gears 94. A preferred material for the socket arm 58 is a 30% glass filled Nylon, however any other suitable material may be chosen which is sufficiently rigid.

As shown in FIG. 4, the pin arm 60 has a base portion 198 and a main shaft 116 extending normal (perpendicular) to the base portion, wherein the main shaft 116 terminates in a retention feature 200 such as a snap lock 202. The base portion is preferably cylindrical 204 and further comprises a lower sun gear 90. The pin arm 60 also has a pin arm member 206 attached to the base portion 198 on a first end 208 and terminating in a pivot attachment mounting feature 210, such as a through hole 212 or slot (not shown) located on a second opposite end 214. In one preferred embodiment of the invention, the pin arm's base portion 198, and main shaft 116 have a through hole 216 placed through the component allowing for one or more cable assemblies 68 to pass from the lower mechanism 52, through the pin arm 60, into the upper mechanism 54. A preferred material for the pin arm 60 is a 20% glass filled polypropylene, however any other suitable material may be chosen which allows for a one time deformation of the main shaft retention feature 200 during assembly.

The construction and orientation of the gears used in the arm rest assembly 50, including those in both the lower mechanism 52 and upper mechanisms 54, may be of any type or sort known to the industry, at any pitch, and at any angle which is able to function in the assembly as described. These gear types include but are not limited to spur, helical, double helical, bevel, spiral, hypoid, crown, worm, epicyclic, cage, rack and pinion, harmonic, and sun and planet gears. However any other suitable material or gear style may be chosen which allows for sufficient rigidity and proper (non-binding) operation. To prevent binding and allow for smooth motion, the moving components of the armrest assembly 50 may also be lubricated, preferably with a paraffin and hydrogenated mineral oil mixture, such as 'Door-Ease', manufactured by AGS, Inc. so long as care is taken to prevent lubricant from touching items described as frictional faces.

An alternate form of the lower mechanism modifies the system above by removing the epicyclic gearsets entirely and directly couples an alternate anti-rotation system with the cylindrical surfaces (178, 204) of the pin arm 60 and/or socket arm 58. In this form of the invention, the anti-rotation system may include an actuator button 66 which directly interfaces with the sun gear (90, 92) on the pin arm 60 or socket arm 58, or may include an anti-rotation mechanism driven by the cable assembly 68. Such anti-rotation mechanisms include but are not limited to band brakes, drum brakes, disc brakes, and inclined planes (wedges), all of which are suitable to prevent rotation of the pin arm 60 and socket arm 58 within the support column 56. This alternate anti-rotation system in turn fully controls the rotation and lateral displacement of the upper mechanism 54 once it is attached to the pin arm 60 and socket arm 58.

Figure 10:
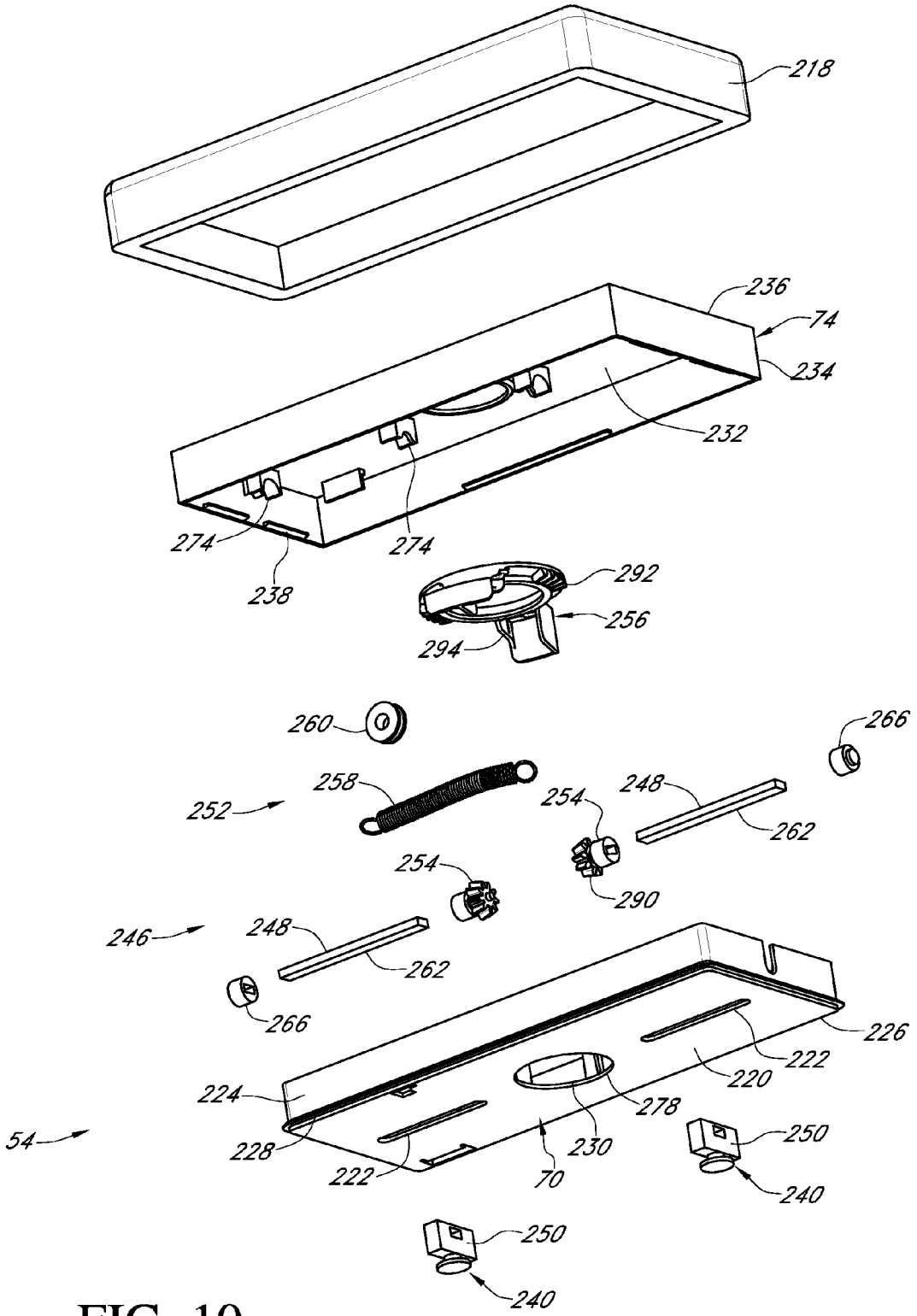
FIG. 10 is an exploded view of the upper mechanism shown in FIG. 4 showing a first form of a fore-aft retention system.

One form of an upper mechanism 54 for use with an adjustable armrest assembly 50 is shown in FIG. 10 and preferably comprises a mounting plate 70, and a cover 74 with a soft outer coating 218. The form of the mounting plate 70 is shown in FIGS. 10 through 16 and comprises a base portion 220, at least one slot 222 through the base portion 220, and an optional outer wall 224 attached to the base portion 220. In a preferred form, the outer wall 224 is located at the periphery 226 of the mounting plate 70 and further contains a cover retention feature 228. The mounting plate in FIG. 11, further includes a hole 230 placed through the base portion 220, preferably located above the through hole 216 in the pin arm 60 when assembled, and is sized to prevent the cable assembly 68 from becoming pinched between the base portion 220 of the mounting plate 70 and the pin arm 60. A preferred material for the mounting plate 70 is a 20% glass filled polypropylene, however any other suitable material may be chosen which allows for sufficient rigidity and for assembly with the cover 74.

One form of the cover 74 is shown in FIG. 17 and depicts an optional soft covering 218 such as reaction injection molded foam overmolded onto the upper surface of the cover 74. The cover 74 element represents the surface presented to the user's arm when used with a chair 40, and it is preferred that this surface is as comfortable as possible.

The form of the cover 74 shown in FIG. 17 comprises a lower surface 232 having a plurality of attached sidewalls 234 located at its periphery 236, which are sized to fit over the mounting plate 70 and attached outer walls 224 (if included). The cover's side walls 234 may also contain an optional mounting plate retention feature 238. A preferred material for the cover 74 is a 30% glass filled Nylon 6, however any other suitable material may be chosen which allows for sufficient rigidity, and allows for assembly with the mounting plate 70.

The first embodiment of the upper mechanism 54, shown in FIG. 10, is attached to the lower mechanism 52 by passing a first fastener through the mounting plate 70 and into a first arm (58 or 60) of the lower mechanism 52, and then passing a second fastener through the mounting plate 70 and into a second arm (58 or 60). If the pin arm and socket arm members contain slots, the mounting plate may simply contain thru holes (not shown) for mounting the fasteners. In one preferred form of the invention shown in FIG. 4, the arms have through holes 212 and the fastener may be passed through a slot 222 in the mounting plate 70. The preferred fastener for attaching the arms (58, 60) should allow the arms to freely pivot on the mounting plate 70, while allowing at least the first fastener to traverse along the length of a slot, either in the arm member (182, 206), or in the mounting plate 70. This allows the pin arm 60 and socket arm 58 of the lower mechanism 52 to rotate through their full range of motion in the lower mechanism 52 while pivotally attached to the mounting plate 70. In turn this allows the upper mechanism to move laterally and rotate about the support column 56 when the lower mechanism's anti-rotation 64 feature is disengaged. (See FIG. 9.)

In another preferred form of the invention, the second fastener may also be placed into a slot either in the arm member (182, 206), or in the mounting plate 70 instead of into a hole. This modification utilizes two fasteners, both placed into a slot, allowing the entire upper mechanism 54 to move in the fore and aft directions (along the direction of the slot). However, without restraint, the upper mechanism 54 will freely slide in the fore-aft direction along the orientation of the slot (such as slot 222 in the mounting plate 70). Since this motion may not always be desirable, an additional fore-aft restraint system 72 may be added to the mounting plate 70 or arms (58, 60) in order to restrain the motion of at least one of the fasteners along the slot, thereby restraining the entire upper mechanism 54 when the fore-aft restraint 72 is engaged.

A first preferred embodiment of the fore-aft restraint system 72 is shown in FIG. 10 and includes two specialized fasteners called pivot attachments 240. In this embodiment, each pivot attachment 240 is placed through a slot 222 in the mounting plate, and pivotally fastens the mounting plate 70 to the pin arm 60 and socket arm 58 of the lower mechanism 52. A preferred material for the pivot attachment 240 is a 20% glass filled polypropylene, however any other suitable material may be chosen which allows for sufficient rigidity and for assembly with the arms (58, 60). The embodiment of the armrest assembly shown used in FIG. 10 allows for the pivot attachments 240 to be pre-installed to the pin arm 60 and socket arm 58, thereby aiding the assembly and attachment of the upper mechanism 54 to the lower mechanism 52. If pre-installation is desired, the pivot attachments 240 may be attached to the arms (58, 60) via an installation window 242 located at the distal end of each arm (See FIG. 7). This allows the pivot attachment 240 to be passed through the installation window 242 located in the arm member and restrained to the arms (58, 60) via a set of pivot locks 244, which serve to couple the pivot attachments 240 to the arms (58, 60) thereby preventing any translation while allowing them to rotate in at least one direction. If preassembly is not desired, the pivot attachments may be snap locked, clipped, pinned, bolted, or threaded into the pin arm 60 and socket arm 58 by any known attachment method, so long as the pivot attachments are fastened to the arms (58, 60) in a manner that allows the arms to freely rotate.

Once the pivot attachments 240 are passed through the mounting plate 70 and attached to the arms (58, 60) the upper mechanism 54 becomes mechanically coupled to lower mechanism 52 via the mounting plate 70. If one pivot attachment 240 is placed through a through hole in the mounting plate 70, and a second pivot is placed through a slot 222 in the mounting plate 70, the upper mechanism 54 will be limited to only lateral and rotation motions. If however, both pivot attachments 240 are located in one or more preferably parallel slots, the pivot attachments 240 may then freely transit along the slots 222. In turn, this allows the mounting plate (and attached cover) to freely move in the direction along the slot 222 (fore-aft direction) adding an additional form of adjustability. However, this new motion along the slot must be limited by restraining at least one of the pivot attachments 240 with a braking system 246.

A first form of the braking system 246 for use in restraining a pivot attachment 240 from moving along the slot 222 is created by placing a torque bar 248, preferably of a non-circular shape, parallel to the slot 222 and through an aperture 250 located in the face of the pivot attachment 240. The pivot attachment's aperture 250 is preferably sized to create a clearance fit (including loose running to sliding fits) between the torque bar 248 and the aperture 250 in a first orientation, and a frictional or interference fit in a second orientation. Thus when the torque bar 248 is placed in the first orientation, the upper mechanism 54 may freely move along the direction of the slot 222, and when in the second orientation, the upper mechanism's motion along the slot is restrained.

A first implementation 252 of the first braking system 246 is shown in FIGS. 10 through 16, and includes two torque bars 248, two pivot attachments 240, two torque gears 254, an arm gear 256, a return spring 258, a cable assembly 68 and a cable wheel 260. In this embodiment, the cable actuates the arm gear 256, which in turn engages the two torque gears 254 each connected to a rectangular shaped torque bar 248, which further engages the apertures 250 of the pivot attachments 240 as they are rotated.

The torque bars 248 are preferably constructed of rough textured or unpolished steel in a non-circular shape, however any suitable material or shape may be chosen which allows for the torque bar 248 to engage and restrain the pivot attachment 240 in at least one orientation. The construction or shape of the torque bar 248 should create at least one frictional face 262 which is used to maximize the frictional coefficient between the torque bar 248 and a portion of a wall created by the pivot attachment's aperture 250 in at least one orientation. The pivot attachment's aperture 250 is preferably constructed of a brass insert molded into the plastic pivot attachment. Brass is a preferred material for the aperture 250 due to the high coefficient of friction between the materials in the pivot attachment's aperture (brass) and the torque bar's frictional face 262 (preferably steel).

A return spring 258 is included in the preferred form of the first system in order to bias the system into an engaged configuration (See FIG. 16), wherein the torque bars 248 engage the pivot attachments 240 to prevent them from traversing along the slot 222 in the mounting plate 70. The cable assembly 68, in combination with the cable wheel 260, allows a force applied at a remote location to actuate the arm gear 256, causing it to rotate into a disengaged configuration 264 and causing the torque bars to rotate and disengage from the pivot's aperture 250 allowing the pivot attachments 240 to traverse along the slot 222 in the mounting plate 70.

Figure 11:
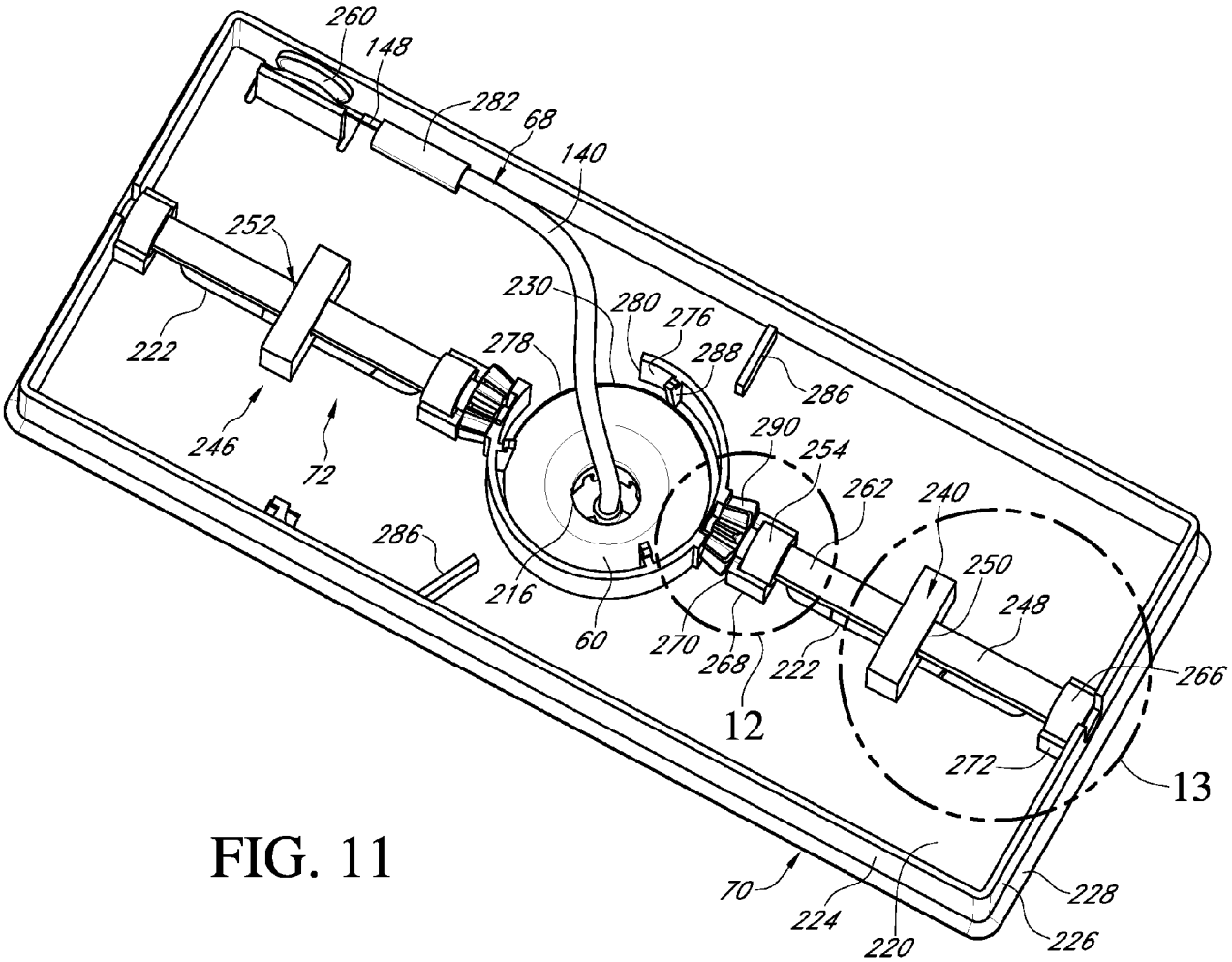
FIG. 11 is a perspective view of a first form of the upper mechanism partially assembled, the upper mechanism showing a torsion bar, a swivel and a torque gear fitted to the mounting plate.
Figure 13:
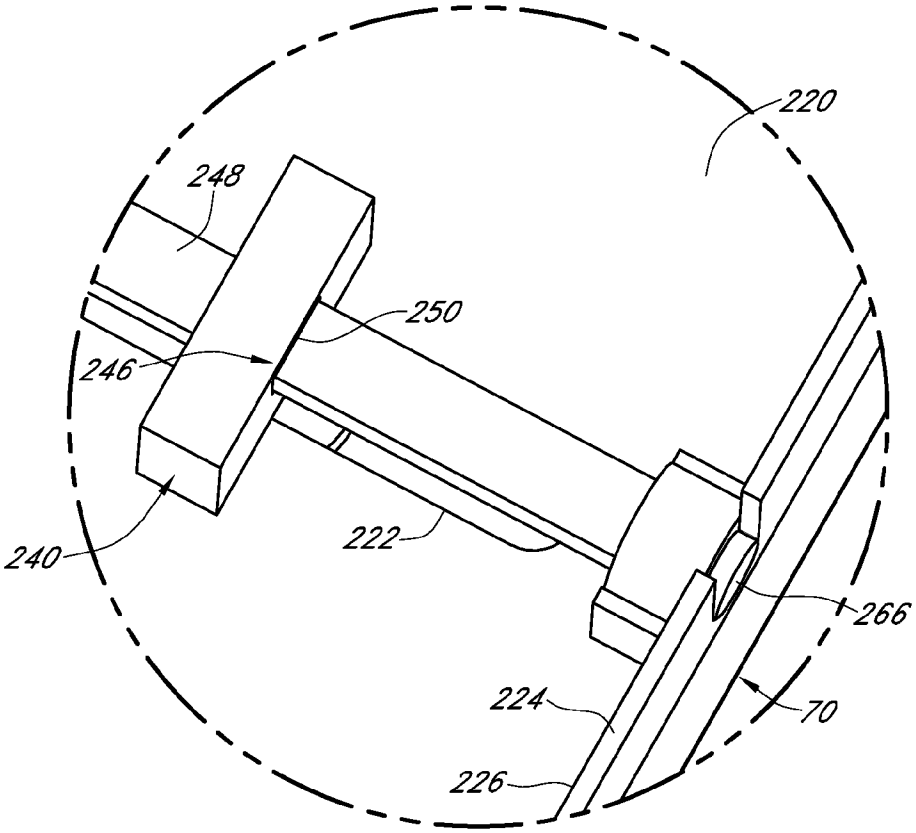
FIG. 13 is a detail view of the swivel, pivot attachment, and torque bar of FIG. 11.
Figure 12:
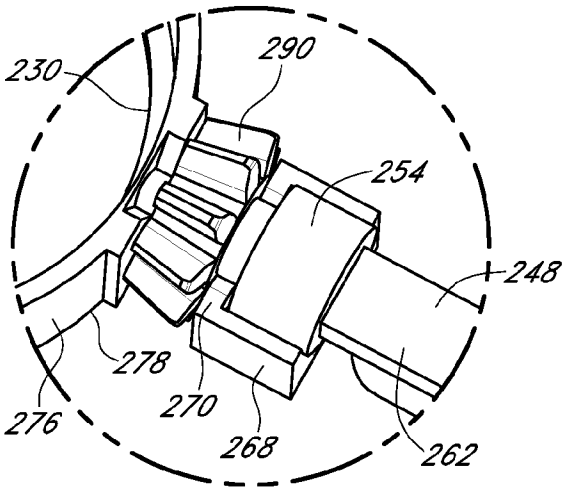
FIG. 12 is a detail view of the torque gear of FIG. 11.

In order to support and actuate the torque bars 248, a swivel 266 and a torque gear 254 are fitted to each torque bar. The torque gear 254 is positioned so that it interfaces with the arm gear 256, and is supported by a torque gear support 268 located on the mounting plate 70. A torque gear retention feature 270 is included in the mounting plate 70 to capture the torque gear 254 and prevent its translation, while freely allowing it to rotate (See FIG. 12). The swivel is positioned on the side opposite the arm gear 256 and is supported by a swivel support block 272. This swivel support block is shown in FIG. 11 and allows the torque bar to freely rotate. Retention features 274, located in the cover 74 (See FIG. 17) mate with their corresponding lower supports (268, 272), and assist with the retention of the swivel 266 and torque gear 254 when the cover 74 is assembled to the mounting plate 70. A preferred material for the torque gear 254 and swivel 266 are 30% glass filled Nylon 6, however any other suitable material may be chosen which allows for sufficient rigidity.

The mounting plate 70 is adapted to fit the arm gear 256 by placing a hole 230 in its base 220, preferably in a central location. An arm gear support wall 276 is then added at the periphery of the hole 278. This arm gear support wall 276 engages the bottom of the arm gear 256, supports the gear preventing translation, and minimizes the rotational friction between the arm gear 256 and the mounting plate 70. An opening 280 is placed in the arm gear support wall 276 for the cable assembly 68 to be passed from the lower mechanism 52, up through the hole 230 in the mounting plate 70, and through the opening 280 in the support wall 276. The cable assembly 68 is so routed, and its outer jacket 140 is anchored to a cable retention feature 282 located on the mounting plate. A cable wheel 260 is then fitted to the mounting plate in order to reverse the direction of the cable's inner member 148, allowing it to be attached to the arm gear 256. An optional set of arm gear limiters 286 may also be installed to limit the rotational travel of the arm gear 256. In a preferred embodiment of the upper mechanism 54, the arm gear 256 and torque gears 254 are preferably constructed of a 30% glass filled Nylon 6, and are formed as bevel gears.

The arm gear 256 is preferably retained on the mounting plate 70 by several arm gear retention features 288 of a snap lock variety. These arm gear retention features 288 are located at the periphery of the hole 278 and allow the gear to rotate freely, but prevent the arm gear from lifting away from the plate vertically. These features 288 also prevent the torque gear's teeth 290 from slipping under load and ensure that the arm gear's teeth 292 fully engage the teeth 290 of the torque gears 254. The arm gear 256 also has an inner cable mounting attachment 294 which is preferably placed radially as far as possible from the center of the gear in order to maximize the torque transmitted to the torque bar 248. A return spring 258 is also attached, preferably on the opposite side of the arm gear 256 to assist the upper mechanism's fore-aft restraint to return to an engaged configuration 296 (FIG. 16.) Should the cable assembly 68 also connect to the actuator button 66, the return spring 258 may provide a restorative force to the actuator button 66. This restorative force may also be used to assist with the engagement of the anti-rotation 64 feature of the lower mechanism 52, if the operation of the anti-rotation feature 64 is associated with the position of the actuator button 66. In this case, it is desirable that the arm gear 256 be sized diametrically so that the range of motion of the inner member 148 of the cable assembly 68 necessary to disengage the torque bar 248 from the pivot is the same as that needed to disengage the anti-rotation feature 64 from the lower mechanism 52 when the button 66 is depressed. Alternately, instead of diametrically re-sizing the arm gear 256, other mechanical means known in the art may be utilized to synchronize these two mechanisms. One such method includes a tensioner and pulley system (not shown) added to the cable assembly 68.

The first form of the fore-aft restraint system 72 is assembled by passing the cable assembly 68 up through the hole 230 in the mounting plate 70, through the space 280 in the support wall 276, wherein its outer jacket 140 is anchored to a cable retention feature 282 located on the mounting plate. The cable wheel 260 is then fitted to the mounting plate and the cable's inner member 148 is routed over the wheel.

The lower mechanism's 52 pivot attachments 240 are rotated to align with the slot 222 in the mounting plate 70 and are passed through the slot. The pivot attachments 240 are then rotated so that their aperture 250 aligns with the slot 222 in the mounting plate 70. The torque gears 254 are then fitted to the torque gear support blocks 268 and the torque bars 248 are passed through the aperture 250 of the pivot attachments 240. One end of the torque bar is then assembled with the torque gear 254, and the other end of the torque bar is fitted with a swivel 266 which is placed into the swivel support 272.

The arm gear 256 is then fitted to the mounting plate 70, aligned with the hole 230 and support wall 276 and pressed onto the plate. When the arm gear 256 is pressed onto the mounting plate 70 the arm gear retention features 288 snap onto the arm gear 256, holding the arm gear's teeth 292 engaged with the teeth 290 of the torque gear 254. The inner member 148 of the cable 68 is then attached to the arm gear's inner cable mounting attachment 294, and the return spring 258 is attached to the arm gear 256 to bias the system into the engaged configuration. (See FIG. 16.) The cover 74 is then fitted to the mounting plate 70 completing the first embodiment of the upper mechanism 54.

A second preferred form the fore-aft restraint system 300 is shown in FIGS. 18 through 24, and modifies the first preferred fore-aft restraint system 72 by removing the arm gear 256, torque gear 254, and swivel 266 and replacing them with a lever arm 302, an alternate torque gear 304, and a rotational support 306. In this embodiment, the arm gear 256 is replaced by two lever arms 302 each of which engages alternate torque gear 304, causing their respective torque bars 248 to rotate and engage the aperture 250 in the pivot attachment 240, restraining the pivot attachment's motion along the slot 222 in the mounting plate 70.

The lever arm 302 preferably contains a base portion 308, and an arm section 310 having a cable mounting feature 312 on its distal end 314. The lever arm 302 is pivotally mounted to the mounting plate 70, preferably with its rotational center 316 located parallel with the slot 222. The cable assembly 68 is then attached by taking the inner member's 148 first end 318 and fitting it with an alternate return spring 320. The first end 318 of the inner member 148 of the cable assembly 68 is then attached to the lever arm's 302 cable mounting feature 312 as shown in FIG. 23. The other end of the cable (See. FIG. 3) is then actuated by the button 66 in a manner that uses the alternate return spring 320 to bias the anti-rotation feature 64 into an engaged configuration with the annuli (98, 100). A preferred method of interaction with the button 66 is via a cable button wheel 150. A preferred material for the lever arm 302 is a 30% glass filled Nylon 6, however any other suitable material may be chosen which allows for sufficient rigidity.

The lever arm 302 comprises gear teeth 322 on the base portion 308, which mates with the teeth 324 of an adjacent alternate torque gear 304. The alternate torque gear 304 is rotationally mounted to the mounting plate 70, and is preferably mounted in a slot 326 in the outer wall 224 of the mounting plate 70. The alternate torque gear 304 is retained in place by a slot engaging feature 328 in the cover (FIGS. 18 and 22) which presses the alternate torque gear 304 into the slot 326. In turn, the alternate torque gear 304 retains the lever arm 302 in place on the mounting plate 70. A preferred material for the alternate torque gear 304 is a 30% glass filled Nylon 6, however any other suitable material may be chosen which allows for sufficient rigidity.

Following installation of the lever arm, the pivot attachments 240 are then installed onto the pin arm 60 and socket arm 58, preferably at their distal ends. The pivot attachment 240 is then placed through the mounting plate's slot 222, attaching the mounting plate 70 to the lower mechanism 52. Once the pivot attachment is in place, a rectangular shaped torque bar 248 is passed through an aperture 250 in the pivot attachment 240, and then fitted to the alternate torque gear 304. The pivot attachment's aperture 250 is preferably sized to create an open or slip fit between the torque bar 248 and the aperture 250 in one orientation, and a frictional or interference fit in another orientation. A rotational support or alternate swivel 306 is then installed onto the opposite end of the torque bar 248. As shown in FIG. 24, the alternate swivel 306 may be a second alternate torque gear 304 in order to commonize the assembly's components. The alternate swivel 306 is supported by an end support 330 located on the mounting plate 70 and is captured by a mating support 332 on the upper cover 74 (FIG. 22).

In the second preferred form of the braking system, the torque bar 248 is installed by rotating the lever arm 302 away from the outer wall 224, compressing the alternate return spring 320. When released, the lever arm 302 returns to its home position adjacent to the outer wall 224, rotating the alternate torque gear 304 and torque bar 248. This rotation creates a frictional engagement between the torque bar's frictional face 262 and the aperture 250, thereby restricting the pivot attachment's 240 lateral motion along the slot 222.

Once assembled, the second preferred form of the fore-aft restraint system 300 is operated as shown in FIGS. 23 and 24, by causing the lever arm 302 to rotate away from the outer wall 224. This causes a rotation in the alternate torque gear 304 as well as the attached torque bar 248. When the torque bar 248 is aligned with the aperture 250, the pivot attachment may freely traverse along the slot, however when the lever arm 302 returns to a position adjacent to the outer wall 224 in the mounting plate 70, the linear position of the pivot attachment 240 is restrained. One method of causing this rotation includes attaching the first end 318 of the inner member 148 of the cable assembly 68 to the lever arm's 302 distal end. The cable assembly 68 then transmits loads placed upon it by the actuator button 66, allowing the button to control the actuation of the fore-aft restraint system 300. The second preferred embodiment of the upper mechanism 54 is designed to present a minimal vertical profile between the mounting plate 70 and the cover 74, thus minimizing the thickness of the upper mechanism 54 while utilizing a lever arm 302 in combination with an alternate torque gear 304 to minimize the amount of force on the actuator button 66 required to disengage the fore-aft restraint system 300.

Alternate restraint systems which may be adapted for use a fore-aft restraint system include braking mechanisms which directly interface with the lower mechanism's pivot attachment 240 arresting the motion of the pivot attachment 240 in the slot 222 when it is engaged. One preferred form of a braking system comprises a brake pad mounted to the cover 74 or the mounting plate 70 which directly engages the pivot attachment 240.

A second form of a braking system utilizes a member having a cam (lobed shaped end.) This member may be attached to either of the mounting plate 70, the pivot attachment 240, or the cover 74, wherein the camed member pivots and presses against an adjacent structure (mounting plate 70, the pivot attachment 240, or the cover 74) arresting the pivot attachment's 240 linear motion via friction.

A third form of a braking system, places a rail or rod through the pivot attachment 240 similar to the first and second fore-aft restraint systems (72, 300). The cross sectional shape of this rod or rail is not important; however the pivot attachment 240 should be able to freely traverse along the rod in a linear fashion. This rod or rail is then deflected by a cam shaped member, forcing the rail or rod to press against the pivot attachment 240 creating friction. This deflection, and the resulting friction, restrains the pivot attachment's 240 location along the slot 222. One form of this deflection braking system causes a cam to deflect the rod linearly, causing the rod to rub against the pivot attachment's aperture 250. A second form, using a rod having a non-circular cross section, the deflection of the rod is done torsionally, twisting the rod against the opening in the pivot and causing friction between the pivot attachment 240 and the rod. A third embodiment of a deflection restraint system uses a plurality of parallel rods or rails of any cross sectional shape, wherein the plurality of rods or rails are deflected to increase the friction between the rods and the pivot attachment 240. In the multi-rod system, a cam is preferably located adjacent to the rods, forcing at least one rod away from another, thereby deflecting more than one rod and multiplying the frictional force applied to the pivot attachment 240.

A fourth braking system uses a piston and a valve to arrest the motion of the pivot attachment 240. This system may optionally include a hose, and may form a closed circuit. In this instance, the pivot attachment 240 is attached to the piston, and the cable assembly 68 is attached to the valve. When the valve is open, the piston may freely move, allowing the pivot attachment 240 to traverse a slot 222 in the mounting plate 70 or in the arms (58, 60). Compressible fluids, such as air, may be utilized in this form of the braking system, however incompressible fluids, such as liquids are preferred. In embodiments utilizing liquids, a closed loop system is preferred, and may include an optional fluid reservoir. Fluids such as water, hydraulic fluid, or oil are preferred for use with this form of the invention. Further, the system may be modified by removing the aforementioned valve, and using a magneto-rheological fluid. In this embodiment, the cable assembly 68 is used to position a magnet near enough to the piston such that its magnetic field affects the magneto-rheological fluid arresting the motion of the piston and consequently the motion of the pivot attachment 240.

A fifth form of the braking system modifies the arm members (182, 206) by including one or more telescoping members, preferably in the form of concentric pistons. In this embodiment, the mounting plate 70 need not contain slots, as the telescoping members may extend or contact as the arms (58, 60) pivot about the mounting plate 70 and the support column 56. In this instance the telescoping members may themselves be used as the pistons described in the fourth form of the braking system. Here the valve or magnet is used to restrain the length of the telescoping member, arresting the motion of the pivot attachment 240 and consequently the mounting plate 70.

Figure 7:
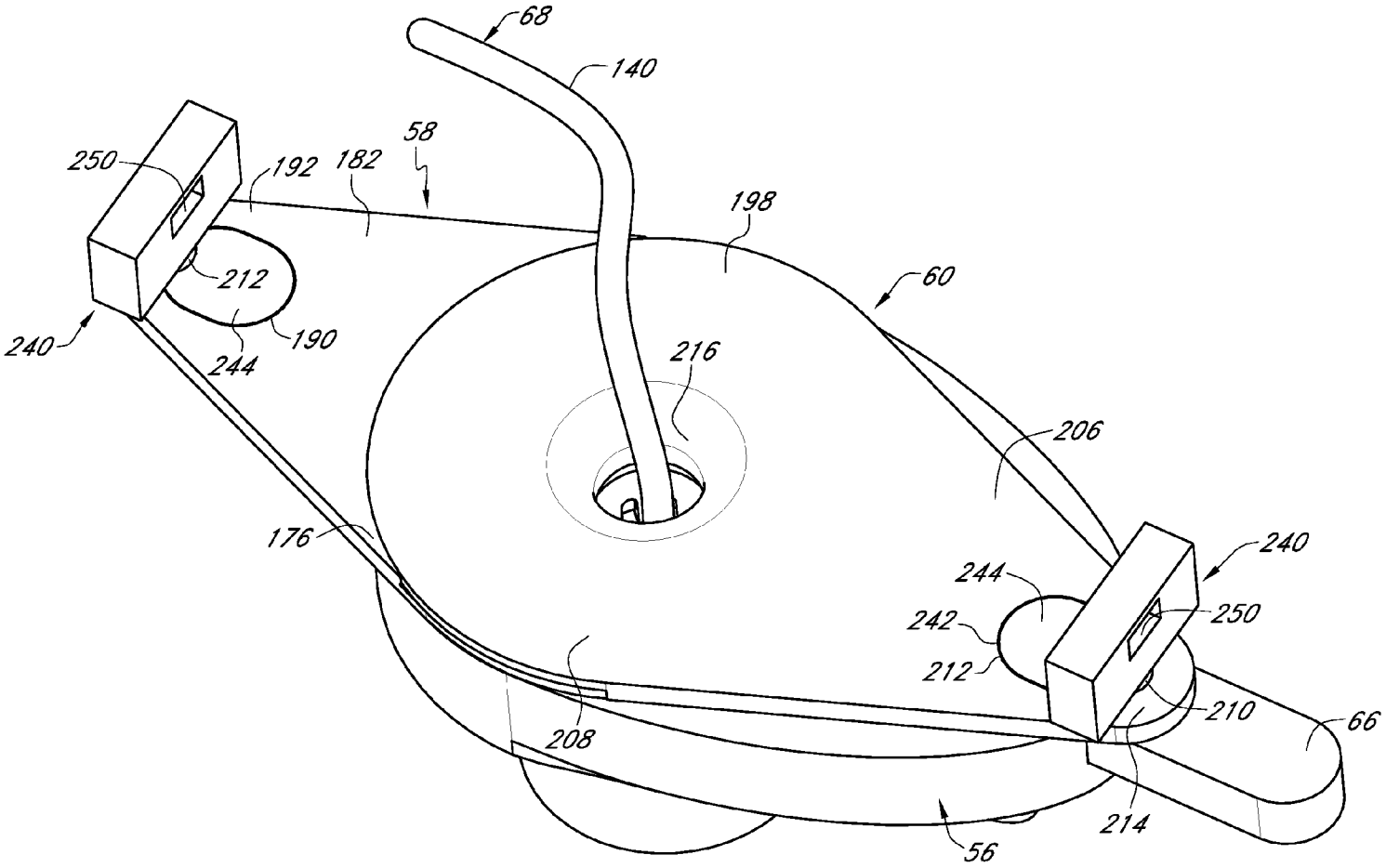
FIG. 7 is a perspective view of an fully assembled lower mechanism showing a pin arm having a pivot attachment attached via a pivot lock, and a socket arm with a pivot attachment attached to a pivot lock, installed into the support column of FIG. 6.

One method of assembling the preferred forms of the adjustable armrest assembly 50 is by fitting the epicyclic gearset 62, button wheel 150, cable housing 138 having an attached cable assembly 68, and an actuator button 66 into the support column 56 (See FIGS. 6 and 7). The inner member 148 of the cable assembly 68 is then actuated by the actuator button 66, preferably through the use of a cable button wheel 150. An optional vertical height adjustment cable is passed out the bottom of the support column 56 and attached to the vertical adjustment in the chair's armrest support 48. The inner member 148 of the cable assembly 68 is then passed upward through the through hole 180 in the socket arm 58, and then the through hole 216 in the pin arm 60. The socket arm 58, and pin arm 60 are then fitted together and placed into the support column 56, causing each component to nest with their respective planetary gearset (94, 96) as is shown in FIG. 7 and in cross section in FIG. 3. The pin arm 60 is then pressed into the support column 56 until the pin arm's main shaft retention feature 200 locks into the column's retention lip 114. This completes one preferred form of the lower mechanism 52.

The upper mechanism 54 may be constructed by fitting the pivot attachments 240 to the distal ends of the pin arm 60 and the socket arm 58. The cable assembly 68 is then passed upwardly through the hole in the mounting plate 230. The pivot attachments 240 are then passed through the slot 222 in the mounting plate 70 and then rotated 90 degrees, retaining the mounting plate 70 to the lower mechanism 52. The outer jacket 140 of the cable assembly 68 is then affixed to the mounting plate's cable retention feature 282. Next, the chosen fore-aft retention system (72, 300) is installed onto the mounting plate 70, and the inner member 148 of the cable assembly 68 is attached to the chosen fore-aft retention system. The torque bar 248 is then passed through the pivot attachment's aperture 250, and a torque gear (254 or 304) and swivel (266 or 306) are installed onto the torque bar. The bar assembly is then placed onto the mounting plate 70, and then lastly, the cover 74 is installed onto the mounting plate 70. This completes the upper mechanism 54, and a preferred form of the adjustable armrest assembly 50.

The principle advantages offered by this invention include manufacturing benefits for the industry, as well as ergonomic benefits for the individual user. The inventive design reduces the number of assembly components to a minimum, thus reducing the manufacturing costs, the assembly complexity, and the number of potential failure modes for the component.

The ergonomical advantages exceed that of the prior art because the current invention is positionable in three or more degrees of freedom, and position changes are accomplished easily through a single actuator button. In the current invention, the fore-aft restraint and the anti-rotation system disengage when the actuator button is depressed, and re-engage when the button is released. This allows the inventive assembly to be positionable anywhere among in the following directions: Neutral, FIG. 25; Lateral Left, FIG. 26; Lateral Right, FIG. 27; Rotated Clockwise, FIG. 28; Rotated Counterclockwise, FIG. 29, Fore, FIG. 30; Aft, FIG. 31. Further, these motions can be combined rendering a nearly infinite number of combined positions, such as Clockwise and Fore which is shown in FIG. 32. Further, the adjustable armrest assembly 50 may even be completely reversed by rotating the upper mechanism 54 more than 180 degrees on the armrest support 48. Even when the assembly is fully reversed it maintains its lateral and fore-aft adjustability, such as is shown in FIG. 33. An optional rotational cable de-coupler may also be included along the path of the cable assembly should extreme rotations (e.g. angles more than 270 degrees) be requested of the assembly. This optional rotational decoupler will help to prevent the cables in the cable assembly 68 from kinking as the upper mechanism 54 is rotated.

One advantage of the assembly's extreme reversibility may be enhanced by using a pin arm member 206 and a socket arm member 182 of dissimilar length, biasing the fore-aft adjustments in one direction. This allows the adjustable armrest assembly 50 to fully accommodate the larger sized individuals by moving the upper mechanism 54 further away from the center of the seating surface 44 in one orientation, while still allowing the assembly to accommodating smaller individuals by rotating the assembly 180 degrees, extending the fore-aft bias toward the center of the seat.

The above description is considered that of the preferred embodiments only. Modifications to the invention will occur to those skilled in the art and those who make use of the invention. Therefore, it is understood that the embodiments shown in the drawings and the examples set forth herein are described merely for illustrative purposes, and are not intended to limit the scope of the invention as interpreted according to the principles of patent law, including the doctrine of equivalents.

The invention claimed is:

1. An adjustable armrest for a chair, comprising:

a support column;

a first arm pivotally attached to said support column;

a second arm pivotally attached to said support column;

a mounting plate; and an anti-rotation feature comprising a plurality of teeth, wherein said first arm is pivotally attached to said mounting plate using a first fastener;

wherein said second arm is pivotally attached to said mounting plate;

wherein said first arm's said first fastener engages a first slot thereby allowing said first arm's said first fastener to traverse along said first slot;

wherein said anti-rotation feature is positionable between an engaged configuration and a non-engaged configuration; and wherein when said anti-rotation feature is placed into said engaged configuration the rotation of said first arm and the rotation of said second arm is restrained, and when said anti-rotation feature is placed into said non-engaged configuration said first arm and said second arms are allowed to rotate.

2. The adjustable armrest of claim 1 wherein:

said second arm is pivotally attached to said mounting plate using a second fastener;

wherein said second arm's said second fastener engages either said first slot or a second slot thereby allowing said second arm's said second fastener to traverse along said first or said second slot.

3. The adjustable armrest of claim 1 wherein:
said first arm further comprises a first sun gear;
said second arm further comprises a second sun gear; and
wherein said anti-rotation feature engages said first sun gear and said second sun gear in said engaged configuration and disengages said first sun gear and said second sun gear in said non-engaged configuration.

4. The adjustable armrest of claim 1 further comprising:
a first sun gear;
a second sun gear;
a first planetary gear;
a second planetary gear;
wherein said first arm actuates said first sun gear;
wherein said first sun gear engages said first planetary gear;
wherein said second arm actuates said second sun gear;
wherein said second sun gear engages said second planetary gear.

5. The adjustable armrest of claim 4 further comprising:
a first annulus gear;
a second annulus gear;
wherein said first planetary gear engages said first annulus gear; and
wherein said second planetary gear engages said second annulus gear.

6. The adjustable armrest of claim 5 wherein:
said first sun gear is integral to a portion of a first arm base extending from said first arm; and
said second sun gear is integral to a portion of a main shaft extending from a second arm base attached to said second arm.

7. The adjustable armrest of claim 5 wherein:
said first planetary gear's location is fixed;
wherein said anti-rotation feature engages said first annulus gear thereby arresting the rotation of said first annulus gear, said first planetary gear, said first sun gear, and said first arm when said anti-rotation feature is positioned into said engaged configuration; and
wherein said set anti-rotation feature disengages from said first annulus gear, thereby allowing the rotation of said first annulus gear, said first planetary gear, said first sun gear, and said first arm when said anti-rotation feature is positioned into said non-engaged configuration.

8. The adjustable armrest of claim 7 wherein:
said second planetary gear's location is fixed;
said anti-rotation feature further comprises a set of lower gear teeth;
wherein said set of lower gear teeth engage said second annulus gear, thereby arresting the rotation of said second annulus gear, said second planetary gear, said second sun gear, and said second arm when said anti-rotation feature is positioned into said engaged configuration; and
wherein said set of lower gear teeth disengage from said second annulus gear, thereby allowing the rotation of said second annulus gear, said second planetary gear, said second sun gear, and said second arm when said anti-rotation feature is positioned into said non-engaged configuration.

9. The adjustable armrest of claim 1 further comprising:
a button controlling the engagement of said anti-rotation feature.

10. The adjustable armrest of claim 1 wherein when said anti-rotation feature is in said engaged configuration said plurality of teeth engages one or more of the following set of gears: a sun gear; an annulus gear; or a planetary gear, and wherein when said anti-rotation feature is placed into said non-engaged configuration said plurality of teeth disengages from the same.

11. An adjustable armrest for a chair, comprising:
a support column;
a socket arm comprising a socket arm base, and a socket arm member attached to said socket arm base;
a pin arm comprising a pin arm base, a pin arm member attached to said pin arm base, and a main shaft extending away from said pin arm base;
a mounting plate including a base portion having at least one slot;
a first pivot attachment pivotally attached to said socket arm member;
a second pivot attachment pivotally attached to said pin arm member;
an anti-rotation feature positionable between an engaged configuration and a non-engaged configuration;
an actuator button controlling the position of said anti-rotation feature;
wherein said socket arm is pivotally mounted to said support column;
wherein said pin arm is pivotally mounted to said support column;
wherein said first pivot attachment engages said slot in said mounting plate, pivotally attaching said mounting plate to said socket arm member and allowing said first pivot attachment to traverse along said slot;
wherein said second pivot attachment engages said slot in said mounting plate, pivotally attaching said mounting plate to said pin arm member and allowing said second pivot attachment to traverse along said slot;
wherein when said anti-rotation feature is placed into said engaged configuration the rotation of said pin arm and said socket arm is restrained, and when said anti-rotation feature is placed into said non-engaged configuration said pin arm and said socket arm are allowed to rotate.

12. The adjustable armrest of claim 11 further comprising;
a first epicyclic gearset comprising a first planetary gear, a first sun gear, and a first annulus gear;
a planetary carrier;
a second epicyclic gearset comprising a second planetary gear, a second sun gear, and a second annulus gear;
wherein when said anti-rotation feature is placed into said engaged configuration, said anti-rotation feature restrains rotation of said pin arm and said socket arm by engaging at least one component of said first epicyclic gearset and at least one component of said second epicyclic gearset.

13. The adjustable armrest of claim 11 wherein said first arm member and said second arm members are of different lengths.

14. The adjustable armrest of claim 11 wherein said pin arm and said socket arm share a common axis of rotation.

15. The adjustable armrest of claim 11 further comprising a fore-aft restraint system positionable into a restrained configuration and a non-restrained configuration, wherein the motion along said slot of at least one of said first pivot attachment or said second pivot attachment is restrained in the restrained configuration, and wherein both of said first pivot attachment and said second pivot attachment are not restrained in the non-restrained configuration.

16. The adjustable armrest of claim 15 wherein said fore-aft restraint system's restrained configuration and non-restrained configuration are controlled via the position of said actuator button.

17. The adjustable armrest of claim 16 wherein said fore-aft restraint system further comprises:

an aperture placed through at least one of said first pivot attachment or said second pivot attachment;

a torque bar having a frictional face;

a braking system;

a push pull cable assembly containing an outer jacket and an inner cable, wherein said inner cable is attached to said braking system at a first end, and is actuated by said actuator button at a second end;

wherein said torque bar is placed through said aperture in at least one of said first pivot attachment or said second pivot attachment;

wherein said actuator button moves said second end of said inner cable causing said first end of said inner cable to actuate said braking system causing said torque bar's said frictional face to engage said aperture of said first pivot attachment or said second pivot attachment in said restrained configuration, and disengages from said aperture of said pivot attachment in said non-restrained configuration.

18. The adjustable armrest of claim 15 wherein said braking system further comprises:

a torque gear attached to said torque bar;

wherein said torque gear rotates said torque bar's said frictional face, thereby engaging said aperture of at least one of said first pivot attachment or said second pivot attachment in said restrained configuration, and wherein said torque gear rotates said torque bar's said frictional face to disengage from said aperture in said non-restrained configuration.

19. An adjustable armrest for a chair, comprising:

a support column;

a socket arm comprising a socket arm base, and a socket arm member attached to said socket arm base;

a pin arm comprising a pin arm base, a pin arm member attached to said pin arm base, and a main shaft extending away from said pin arm base;

a mounting plate including a base portion having at least one slot;

a first pivot attachment pivotally attached to said socket arm member;

a second pivot attachment pivotally attached to said pin arm member;

a first epicyclic gearset comprising a first planetary gear, a first sun gear located on a portion of said socket arm base, and a first annulus gear;

a second epicyclic gearset comprising a second planetary gear, a second sun gear located on a portion of said pin arm's said main shaft, and a second annulus gear;

an anti-rotation feature positionable between an engaged configuration and a non-engaged configuration;

an actuator button controlling the position of said anti-rotation feature;

an aperture placed through at least one of said first pivot attachment or said second pivot attachment;

a torque bar comprising at least one frictional face; and an arm gear pivotally mounted to said base portion of said mounting plate or to a cover;

wherein said socket arm is pivotally mounted to said support column;

wherein said pin arm is pivotally mounted to said support column;

wherein said first pivot attachment engages said slot in said mounting plate, pivotally attaching said mounting plate to said socket arm member and allowing said first pivot attachment to traverse along said slot;

wherein said second pivot attachment engages said slot in said mounting plate, pivotally attaching said mounting plate to said pin arm member and allowing said second pivot attachment to traverse along said slot;

wherein when said anti-rotation feature is placed into said engaged configuration the rotation of said pin arm and said socket arm is restrained, and when said anti-rotation feature is placed into said non-engaged configuration said pin arm and said socket arm are allowed to rotate;

wherein said actuator button causes said arm gear to position said torque bar between a restrained and unrestrained configuration, wherein in said restrained configuration, said torque bar engages said aperture of either of said first pivot attachment or said second pivot attachment, thereby arresting motion of at least one of said first pivot attachment or said second pivot attachment along said slot, and wherein in said unrestrained configuration, said torque bar disengages from said aperture of both said first pivot attachment and said second pivot attachment, thereby allowing motion of both said first pivot attachment and said second pivot attachment along said slot.

20. The adjustable armrest of claim 19 wherein said pin arm and said socket arm share a common axis of rotation.

21. The adjustable armrest of claim 19 wherein said first arm member and said second arm members are of different lengths.

* * * * *